United States Patent [19]

Sjogren et al.

[11] Patent Number: 4,812,099

[45] Date of Patent: Mar. 14, 1989

[54] SIGNATURE STACKER

[75] Inventors: Christer A. Sjogren, Miami; Carl D'Amico, Ft. Lauderdale, both of Fla.

[73] Assignee: Quipp Incorporated, Miami, Fla.

[21] Appl. No.: 47,008

[22] Filed: May 5, 1987

Related U.S. Application Data

[62] Division of Ser. No. 707,494, Mar. 1, 1985, Pat. No. 4,678,387.

[51] Int. Cl.[4] ..... B65H 31/30

[52] U.S. Cl. ..... 414/788.2; 414/903; 414/790.3; 414/792.3; 198/726

[58] Field of Search ..... 414/31, 43, 46, 65, 414/66, 903; 198/726

[56] References Cited

U.S. PATENT DOCUMENTS

| | | | |
|---|---|---|---|
| 3,532,230 | 10/1970 | Gutberlet et al. | 414/46 X |
| 3,822,793 | 7/1974 | Stobb | 414/90 X |
| 3,971,467 | 7/1976 | Anderson | 198/726 |
| 4,068,567 | 1/1978 | Allison et al. | 414/31 |
| 4,103,785 | 8/1978 | Wiseman | 414/31 |
| 4,198,901 | 4/1980 | Knudsen | 198/726 X |
| 4,457,656 | 7/1984 | Kosina et al. | 414/31 |

*Primary Examiner*—Leslie J. Paperner
*Attorney, Agent, or Firm*—Louis Weinstein

[57] ABSTRACT

A stacker having platforms movable along a path by chains. Cam followers on the platforms engage a cam surface which controls the platform path. The chains are driven by a motor in a closed-loop system which monitors the platforms and controls their speed. The closed-loop system first decelerates the platforms and thereafter stops one platform in the intercept-ready position. The platform cam follower enters a claw which moves the end of the platform through the stream to collect signatures when the downstream platform reaches a predetermined count and deposits the stack on a turntable. A piston assembly rotates the turntable one-half turn after each deposit. Different pressure values are selectively applied to the piston assembly to slow the turntable before it is halted. A rotatable motor coaxial with the turntable axis drives the pushers through drive chains maintained under tension by gas springs which impose opposing forces upon these chains to maintain chain tension regardless of the direction the chains are driven. Jets on the surface of the turntable selectively emit air when a signature is deposited thereon to facilitate removal of a batch. A microprocessor-based controller continuously monitors and periodically adjusts the drop delay and stacking speed of the chains and the stacking platforms to allow the platforms to collect signatures at the lowest speed commensurate with stack size, to form neat stacks, the latter operation being accomplished by either a table look-up or an on-line calculation technique.

34 Claims, 20 Drawing Sheets

SIGNATURE STACKER

This is a division of application Ser. No. 707,494, filed Mar. 1, 1985, now U.S. Pat. No. 4,678,387.

FIELD OF THE INVENTION

The present invention relates to signature stackers and more particularly to signature stackers having positive piston drive means for driving the stacker platform into the intercept position; and having a novel turntable assembly for forming compensated bundles and having a microprocessor based controller for controlling the starting, stopping and variable velocity of both the stacking platforms and turntable.

BACKGROUND OF THE INVENTION

Signature stackers are presently in wide-spread use for counting and stacking signatures and the like. Such signature stackers are typically provided with stacking platforms which are moved through the incoming signature stream to intercept the signature stream and collect signatures thereon when the platform previously receiving signatures has accumulated the desired number of signatures. The signatures collect on the stacking platform until the next stacking platform spaced therefrom is caused to intercept the signature stream whereupon the signatures are thereafter collected on said next stacking platform. The criteria for intercepting the signature stream is dependent upon the count of signatures desired to be collected on the previous stacking platform, which count is selected in accordance with the requirements of the user.

The stacking platform supporting the desired number of signatures drops out from beneath the accumulated stack enabling the stack thereon to fall between two assemblies mounted on a turntable and including a movable "picket fence" and pusher arm/gates arranged upon the turntable and moveable to push a completed batch from the turntable and delivery it to an associated conveyor. The turntable is then rotated through one half revolution prior to receipt of the next stack to form compensated bundles.

The stacking platform which is rapidly moved down from beneath the stack of signatures is eventually returned to the intercept position in readiness for intercepting the over-lapping signature stream when the next preceding stacking platform has received the desired number of signatures.

The stacking platforms are driven by a heavy-duty motor controlled by control means to move the stacking platform a first velocity during stacking and as it returns to the intercept position and to reduce the motor output speed to thereby reduce the velocity of the stacking platform as it approaches the intercept position and thereafter to half the stacking platform upon reaching the intercept ready or "home" position. The position of each stacking platform is continuously monitored by means of a gear whose angular velocity is a function of the instantaneous velocity of the stacking platform and a cooperating sensor for generating pulses upon sensing the teeth of said gear passing the sensor.

A reciprocating claw is arranged at the intercept-ready position so that a cam follower roller means associated with each stacking platform enters into the claw when the platform is in the intercept-ready position. A predetermined delay interval after the cam follower roller enters the claw, cylinder means coupled to the claw is activated causing the claw and cam follower roller to move in a direction transverse to the path of movement of the stacking platform whereupon the free ends of the stacking platform swing across the path of movement of the signature stream to abruptly intercept the signatures in the signature stream approaching the platform to assure that the number of signatures delivered to the stacking platform previously receiving signatures is equal to a predetermined count and so that those signatures following the last signature to be delivered to the stacking platform last receiving signatures are diverted from the stacking platform containing a completed stack and collected upon the stacking platform which has just intercepted the signature stream.

The aforementioned heavy-duty motor remains deenergized during the time that the claw swingably moves the stacking platform to the intercept position. The heavy-duty motor remains deenergized for a predetermined delay interval sufficient to assure that the last signature delivered to the stacking platform previously collecting signatures is properly received by and collected on said platform.

Upon termination of the aforementioned drop delay, the heavy-duty motor is reenergized causing the stacking platform now receiving signatures to move through the stacking region, collecting signatures from the incoming signature stream until the next stacking platform reaching the intercept ready position moves into the signature stream.

The velocity of the stacking platform moving through the stacking region is primarily a function of the number of signatures to be collected upon the stacking platform and the rate of flow of signatures to the stacker. Monitoring means including a microprocessor continuously monitors and updates the speed control value utilized to control the speed of movement of the stacking platform. The microprocessor generates a ramp signal for accelerating the platform from a standstill to the desired stacking velocity. The microprocessor, whenever possible, reduces the stacking speed of the stacking platform (once per completed stack) to an optimum value which is chosen to assure the formation of a neat stack, adjusting the speed control value a predetermined incremental amount prior to the formation of each subsequent signature stack. The use of a variable speed motor under the control of a microprocessor totally eliminates the need for clutch and brake assemblies typically utilized in prior art equipment and also provides more accurate and reliable control over the stacking operation.

The turntable assembly utilized to form compensated bundles is comprised of a solid unitary turntable having a pair of moveable "picket fence" assemblies each further including a plurality of pusher/gates which, together with the picket fence assemblies, form a receiving pocket for receiving and supporting signature stacks and preventing the signature stacks from toppling during the time that the turntable is rapidly rotated after the receipt of a signature stack and before the receipt of the next signature stack, to form compensated bundles.

Rotation of the turntable through one-half revolution after receipt of each signature stack and before the receipt of the next signature stack permits formation of a compensated bundle.

The turntable is mounted to rotate about a vertical axis. A cylinder assembly drives the turntable through one-half revolution and a cooperating shock absorber assembly, pivotably linked to the turntable operates in a complementary fashion relative to the air cylinder to decelerate and halt the turntable as it approaches the completion of one-half revolution.

Pressure sources of different pressure values are selectively coupled to the air cylinder to reduce the pressure applied to the air cylinder as it nears completion of one-half revolution thus assuring more accurate halting of the turntable.

A novel support for the turntable comprises a hollow cylindrical housing rigidly secured to the stacker main frame. A second hollow cylindrical housing is arranged within the first housing in a concentric manner and is rotatably secured therein by suitable bearings in order to enable the inner housing to rotate relative to the outer stationary housing while preventing the inner housing from experiencing any axial movement.

A variable speed servo motor is secured to the bottom end of the inner housing so as to be rotatable therewith. The variable speed servo motor output shaft is coupled to an intermediate shaft by a reducing gear assembly and a flexible coupling. The intermediate shaft is rotatably maintained along the axis of rotation of said inner housing by bearings and extends upwardly toward the underside of the turntable. A pair of sprockets are mounted at spaced intervals to the upper end of said intermediate shaft for driving a pair of closed-loop chains arranged along the underside of the turntable and each engaging a plurality of sprockets. Two of said plurality of sprockets each impart drive to one of the moving wall or "picket fence" assemblies each being comprised of additional upper and lower horizontally aligned chains having a plurality of "pickets" mounted therealong to form a "picket fence" or "moving wall". Pusher/gate elements are arranged at spaced intervals along each moving wall whereby a pair of said pusher/-gate elements of each moving wall cooperatively form a signature stack receiving area with the moving walls of the two moving wall assemblies to retain the stack or stacks of signatures upright and prevent them from being displaced or toppling as a result of the rapid rotation of the turntable.

When a bundle of either compensated or uncompensated type is completed, the variable speed motor mounted beneath the turntable is energized to rotate the sprockets forming part of each moving wall assembly. The variable speed servo motor operates at a first, higher speed to push a bundle off of the turntable. Sensors sense the approach of the moving wall assembly toward completion of the pushing operation to reduce the speed of the motor, thereby assuring that the motor and hence the pusher/gates will be brought to a halt at the precisely desired position in readiness for receipt and formation of a new bundle.

Upon completion of the pushing operation to push the last completed bundle off at the turntable and upon a cooperating conveyor, the next stack, of signatures is formed and deposited upon the turntable and between the movable walls and pusher/gates. After the deposit of said signature stack and before the deposit of the next signature stack, the variable speed servo motor mounted to the underside of the turntable is maintained deenergized and the air cylinder arranged beneath the turntable is operated to rotate the turntable through one-half revolution, in the same manner as previously described. These operations continue in a repetitive manner to successively form bundles of either the compensated or uncompensated type.

OBJECTS OF THE INVENTION AND BRIEF DESCRIPTION OF THE FIGURES

It is therefore one object of the present invention to provide a novel assembly for collecting and stacking signatures and the like and utilizing reciprocating claw means for imparting positive swinging movement to a stacking platform in the intercept ready position to cause the stacking platform to intercept the incoming signature stream in a positive manner.

Still another object of the present invention is to provide a novel stacking section utilizing stacking platforms for stacking and collecting signatures and the like and including a variable speed drive means and control means for controlling the stopping, starting and moving velocity of the stacking platforms by direct control of the drive means to facilitate the formation of neat signature stacks thereby eliminating the need for clutch and brake assemblies.

Still another object of the present invention is to provide a novel stacking section utilizing stacking platforms for collecting and stacking signatures and the like and comprised of variable speed drive means and control means including monitoring means for continuously monitoring and updating the stacking speed at which the stacking platforms are moved to assure the formation of neat bundles by moving the stacking platforms at the slowest possible stacking speed commensurate with the velocity of the incoming signature stream.

Still another object of the present invention is to provide a novel turntable assembly for forming compensated signature bundles and the like including air cylinder means for rotating the turntable through one-half revolution under control of plural air pressure sources of different pressure levels which are selectively coupled to the air cylinder dependent upon the portion of the rotational cycle.

Still another object of the present invention is to provide a novel turntable for use in forming compensated bundles and the like and comprising air cylinder means for rotating the turntable through one-half revolution wherein a complementary hydraulic cylinder is utilized for decelerating and halting the turntable as it completes one-half revolution.

Still another object of the present invention is to provide a novel assembly for rotatably supporting a turntable used for forming compensated signature bundles and the like comprising an assembly for rotatably mounting the drive motor for the turntable assembly gate/pusher elements whereby the drive motor rotates with the rotation of the turntable and is selectively energizeable upon completion of rotation of the turntable for driving the gate/pusher elements to push a completed bundle off of the turntable.

Still another object of the present invention is to provide drive means for the gate/pusher elements provided on a turntable utilized for forming compensated bundles in which a pair of drive chains are utilized to couple power from the variable speed motor to the gate/pusher elements and including gas-springs cooperating with swingably mounted tensioning sprockets to prevent the drive chain from experiencing any backlash during start-up regardless of the direction of movement of the drive chain.

The above as well as other objects of the present invention will become apparent when reading the accompanying description and drawing in which.

Figure 2:
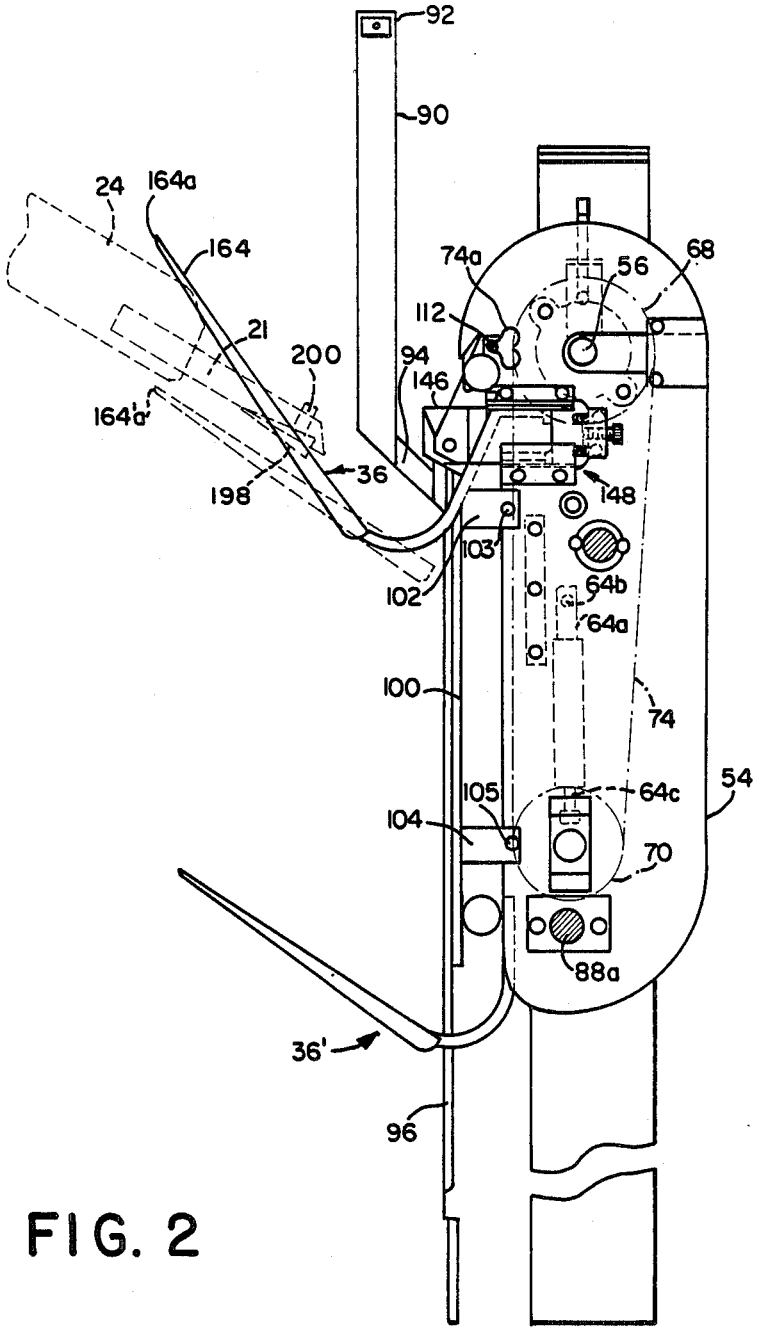
FIG. 2 shows a side elevation of the stacking section embodied in the stacker of FIG. 1.
Figure 3:
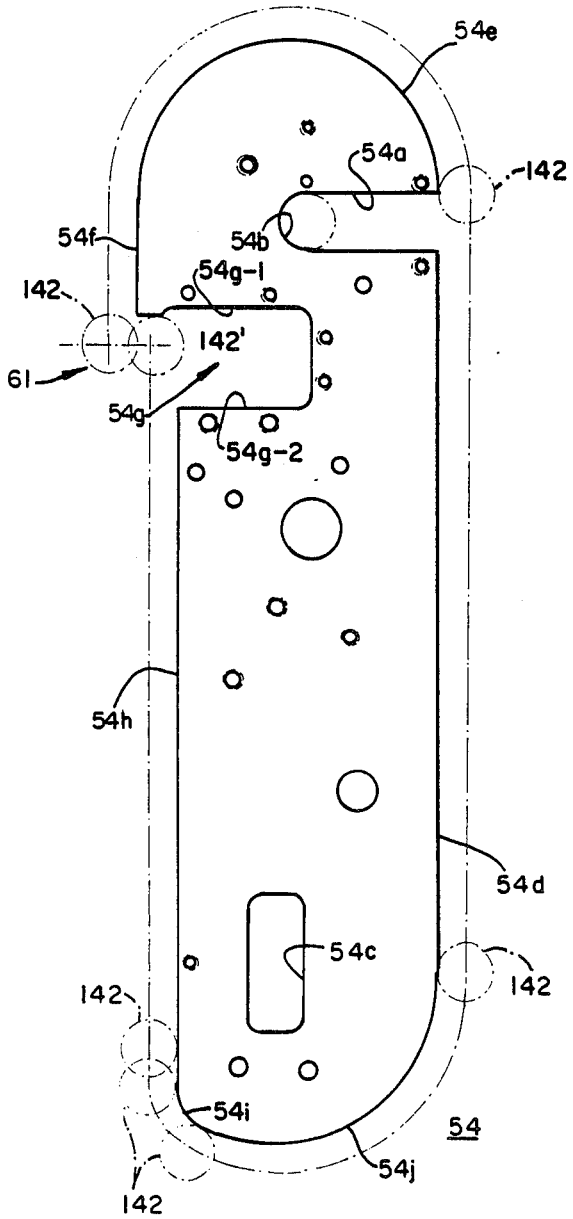
FIG. 3 shows a plan view of one of the combined supports and cam members employed in the stacking section of FIG. 2.
Figure 4:
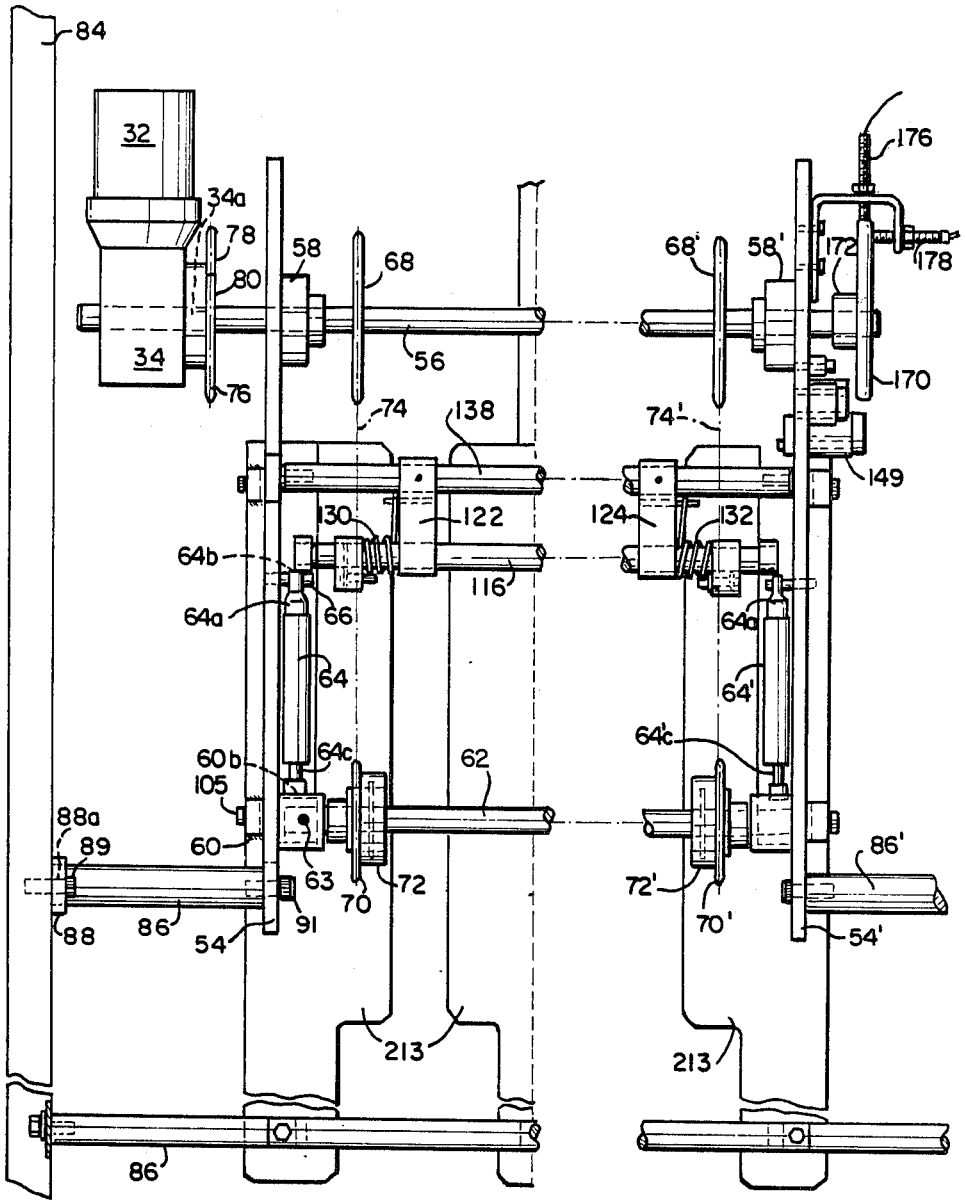
FIG. 4 shows a rear elevational view of the stacking section of FIG. 3.
Figure 4A:
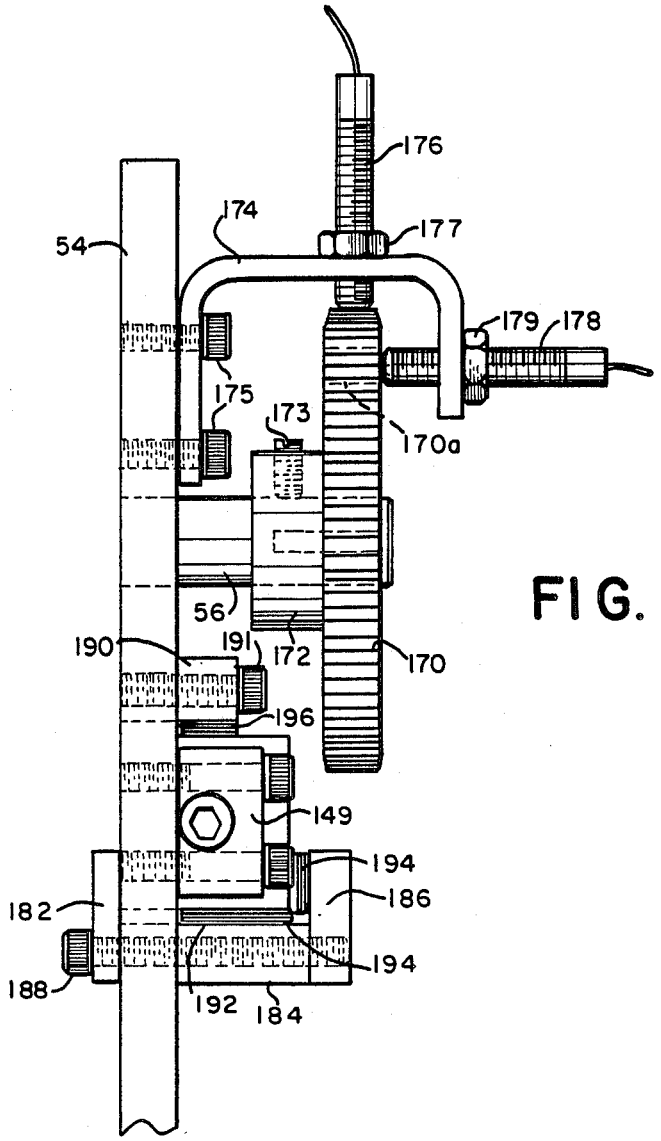
Figure 4B:
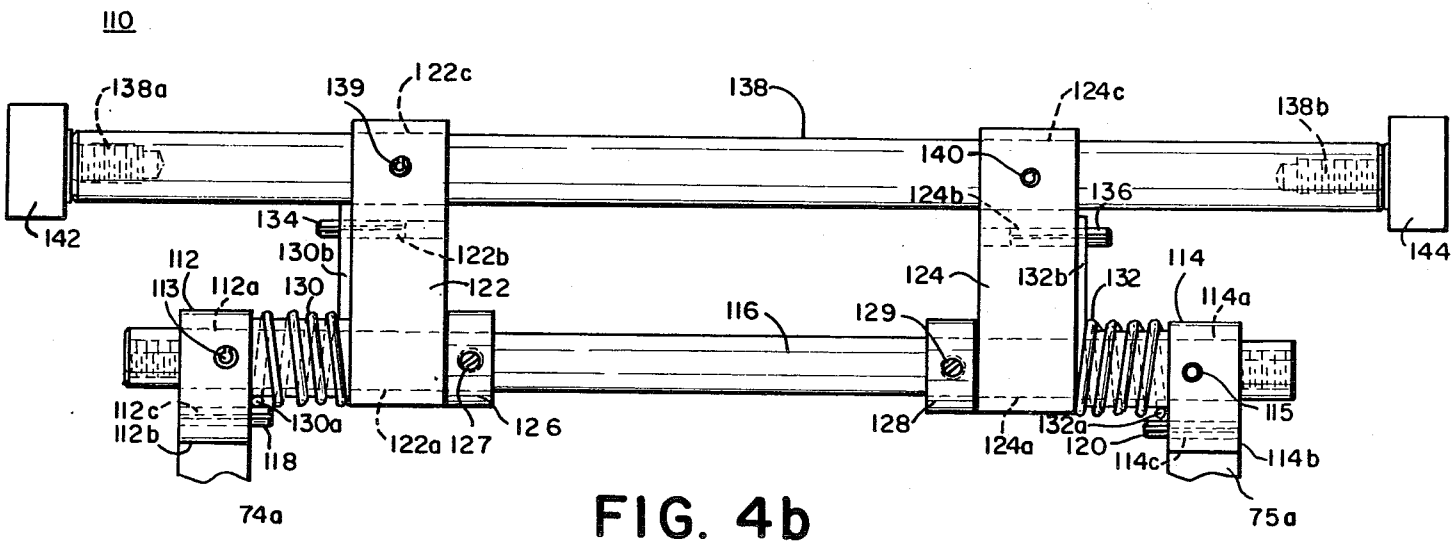
Figure 5A:
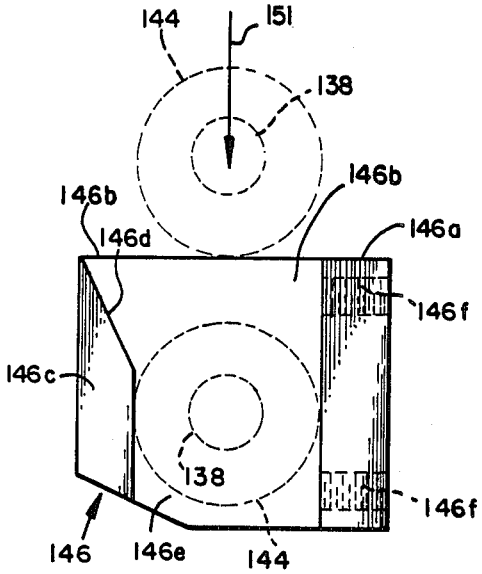
Figure 5B:
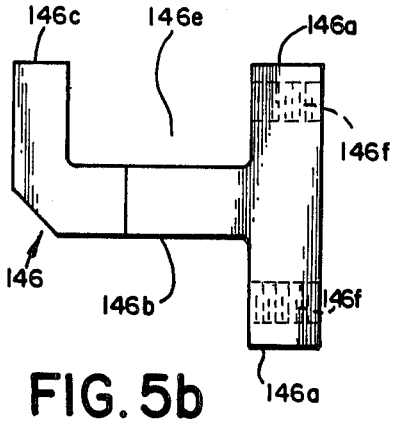
Figure 5C:
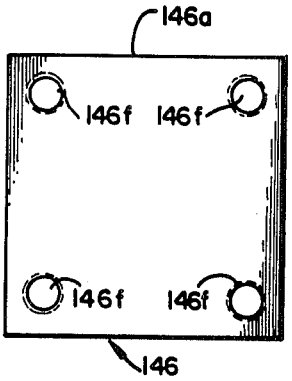
Figure 5D:
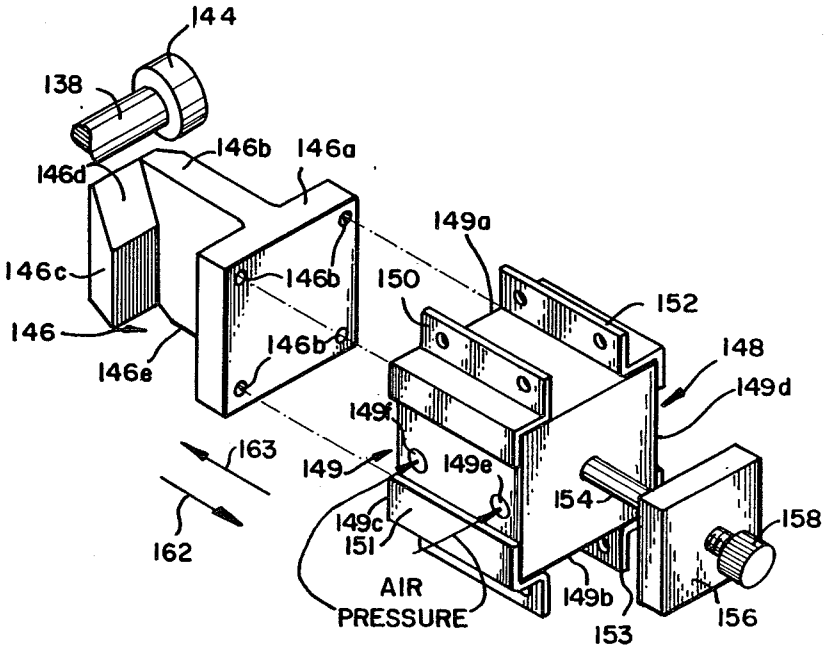

FIG. 4*a* shows a detailed view of the stacking platform monitoring means employed in the stacking section shown in FIGS. 2 and 4;

FIG. 4*b* shows a detailed top plan view of the mounting assembly employed for mounting a stacking platform to the drive chain employed in stacking section of FIGS. 2 and 4;

FIG. 5*a* through 5*d* show side, bottom, end and perspective views respectively of the intercept arm employed in the stacking sections of FIGS. 3 and 4.

Figure 1:
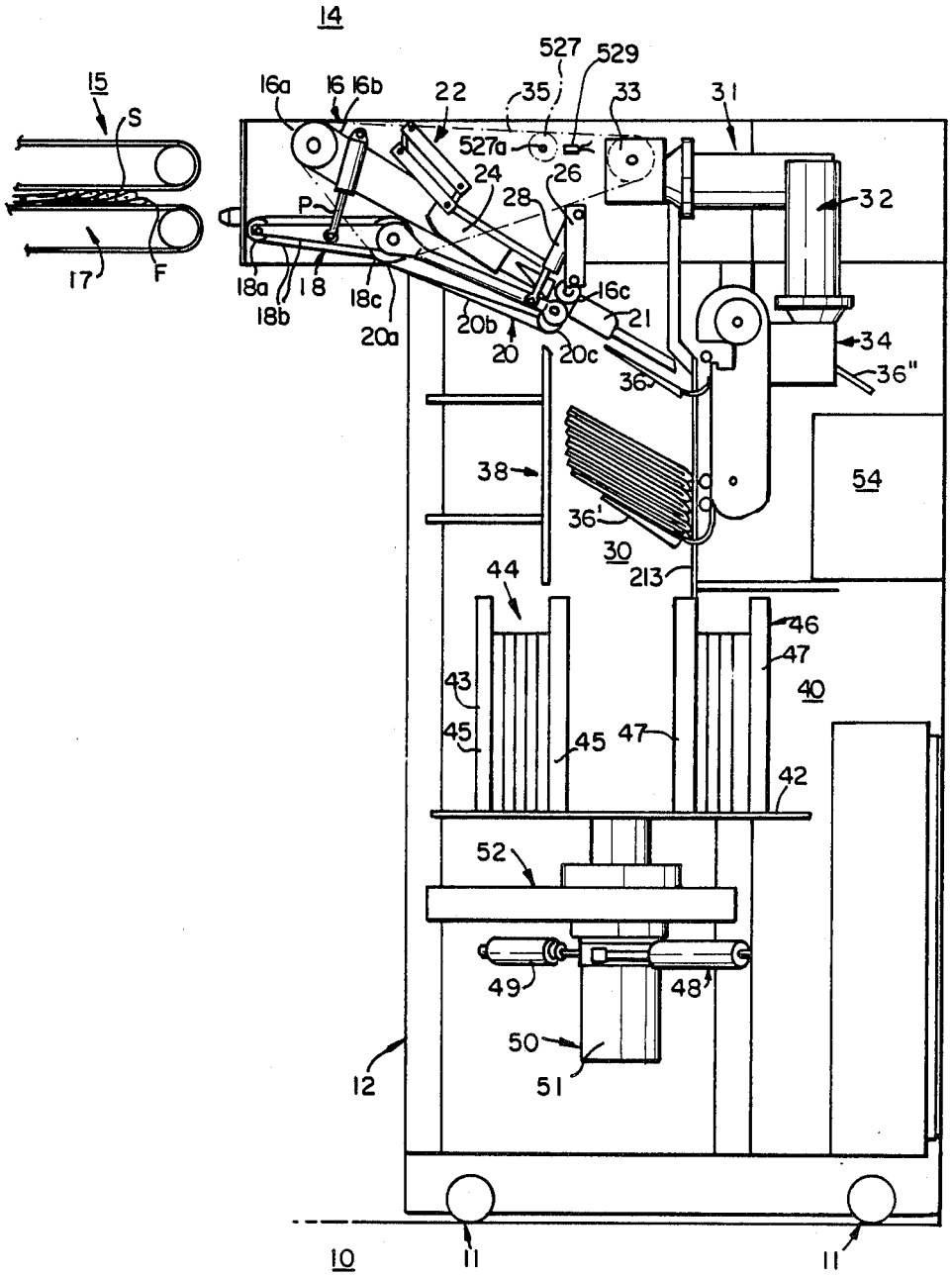
FIG. 1 shows an simplified elevational view of a stacker embodying the principals of the present invention.
Figure 6A:
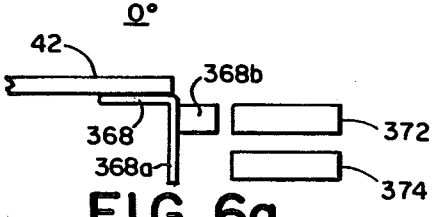
Figure 6B:
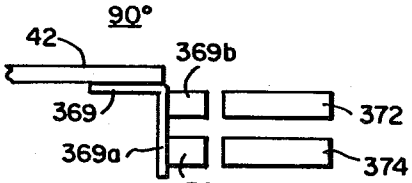
Figure 6C:
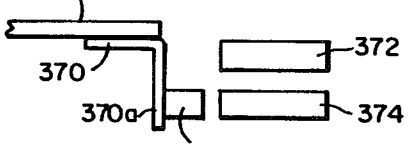
Figure 6:
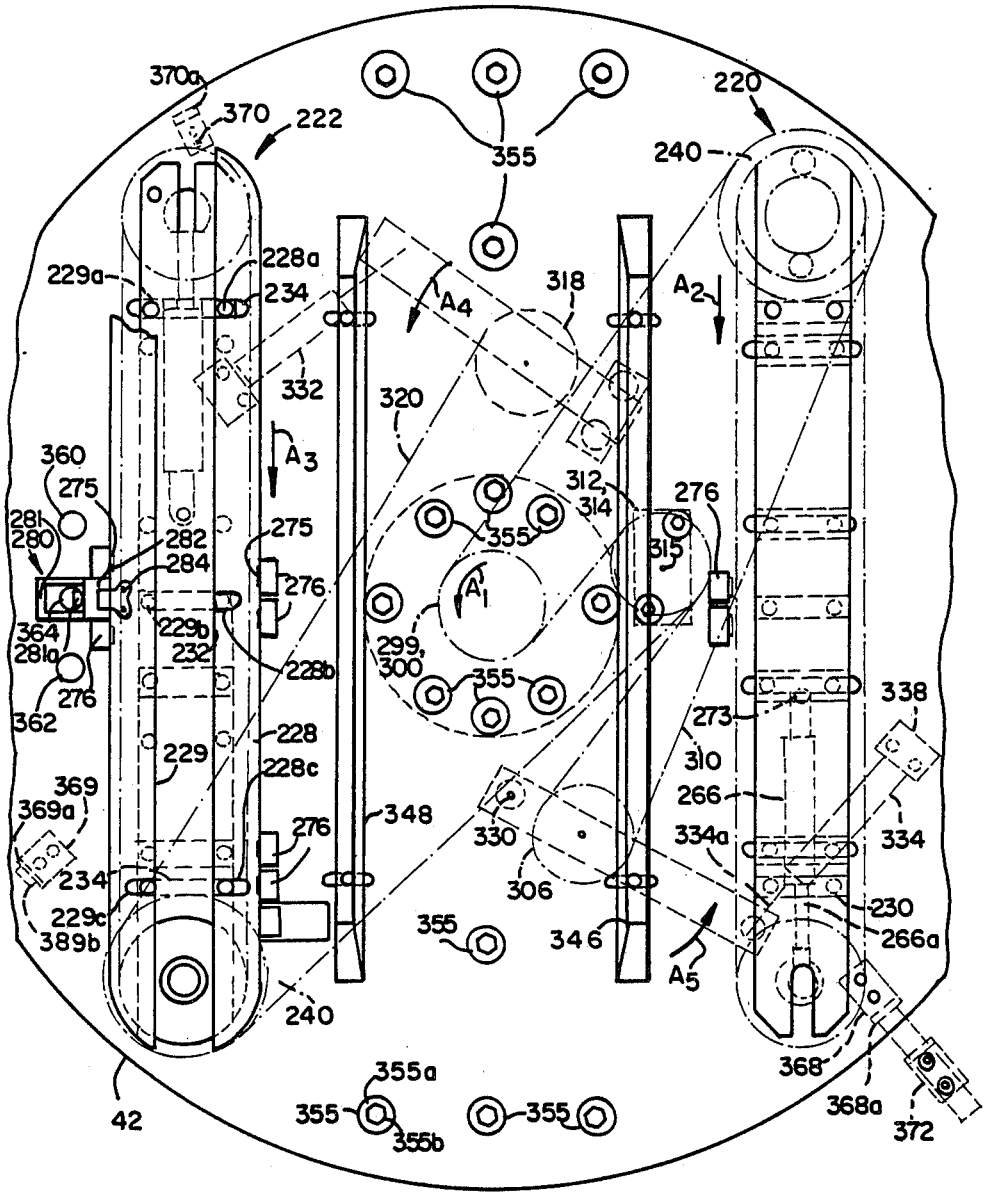

FIG. 6 shows a detailed top plan view of the turntable assembly of FIG. 1;

FIG. 6*a*, 6*b* and 6*c* show developmental elevational views of the sensors and one of the sensed brackets shown in FIG. 6 and which are useful to explain the manner in which the turntable position is determined.

Figure 7:
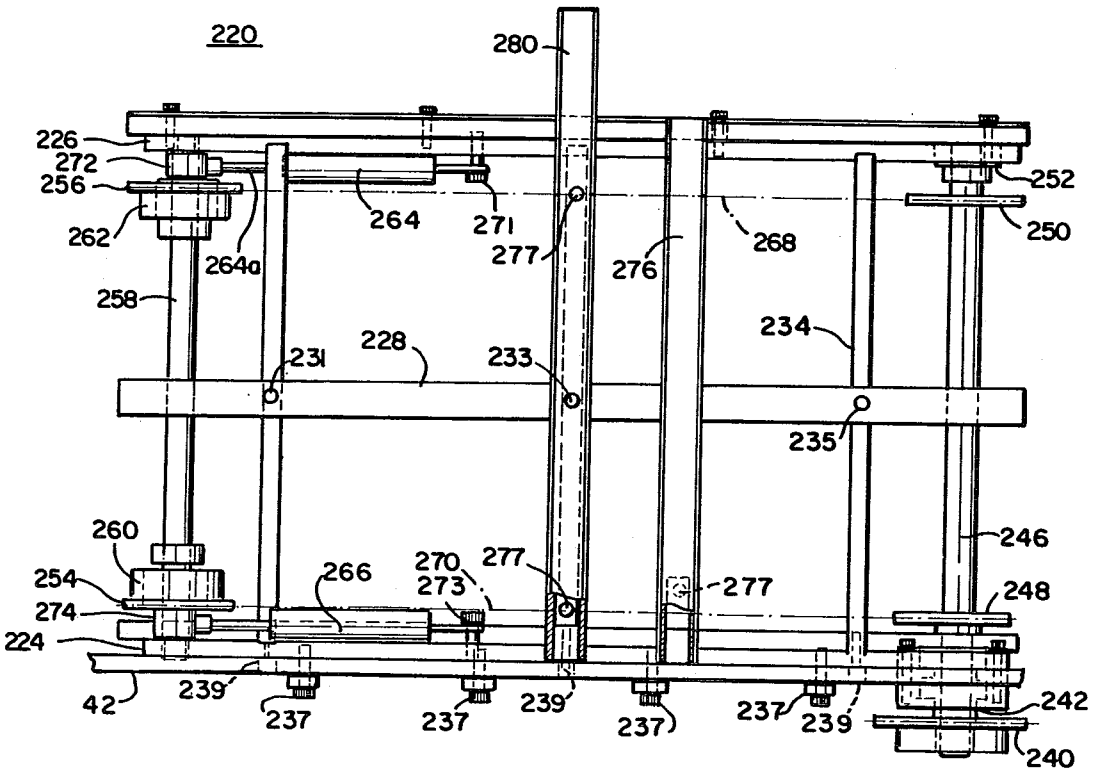
Figure 8:
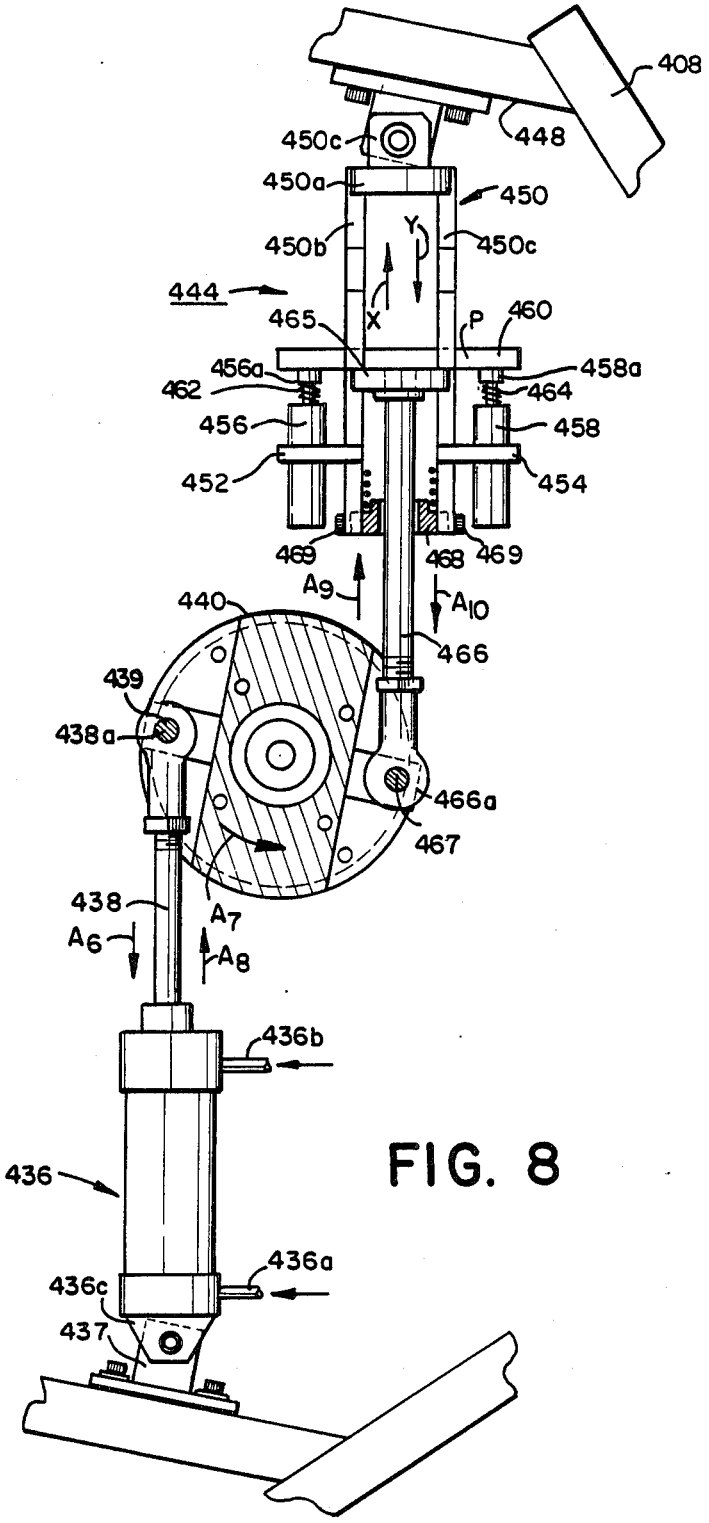
Figure 9:
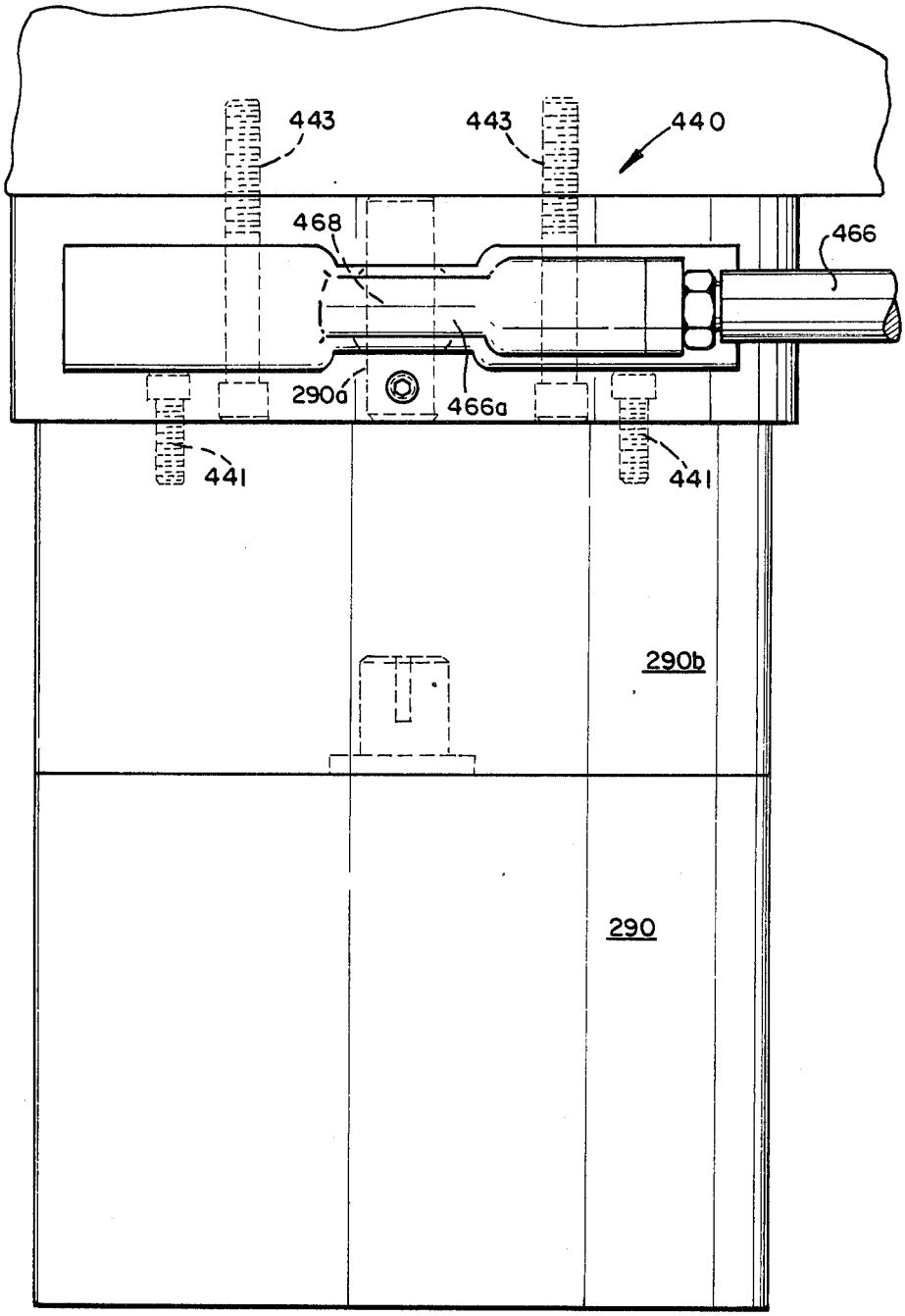
Figure 10:
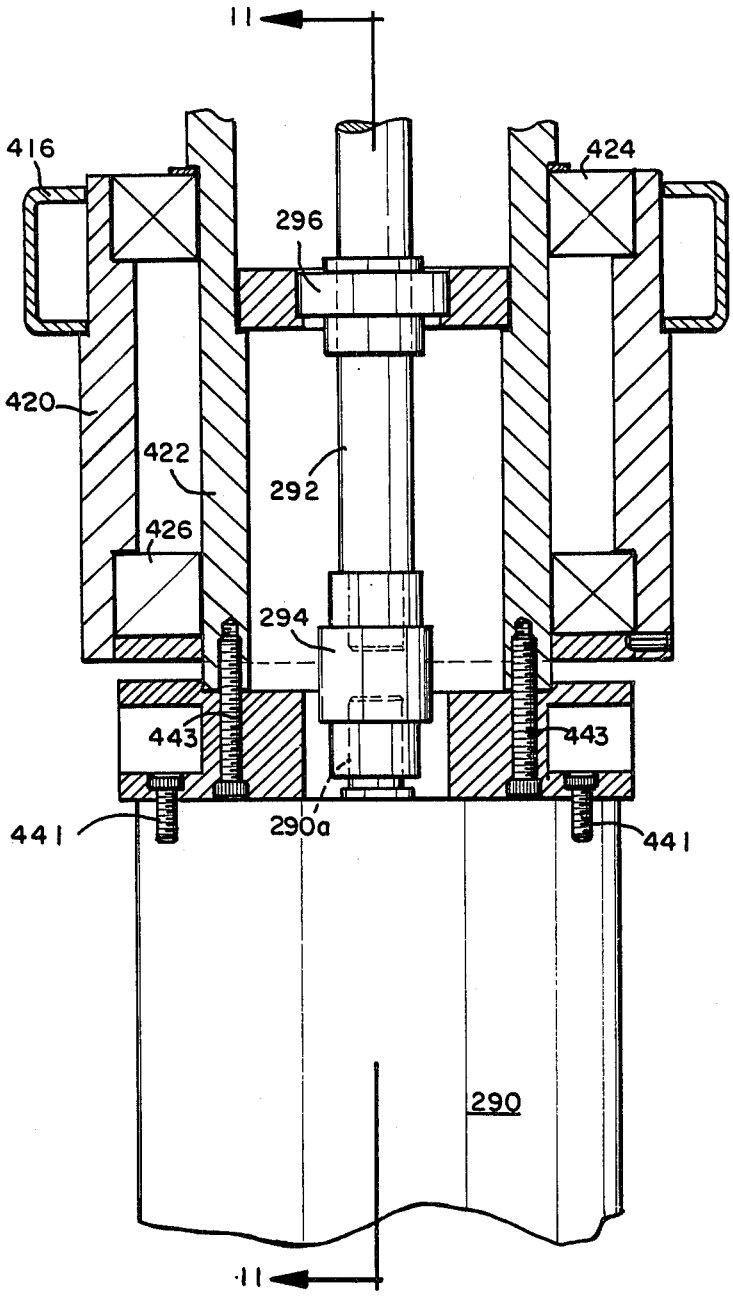
Figure 11:
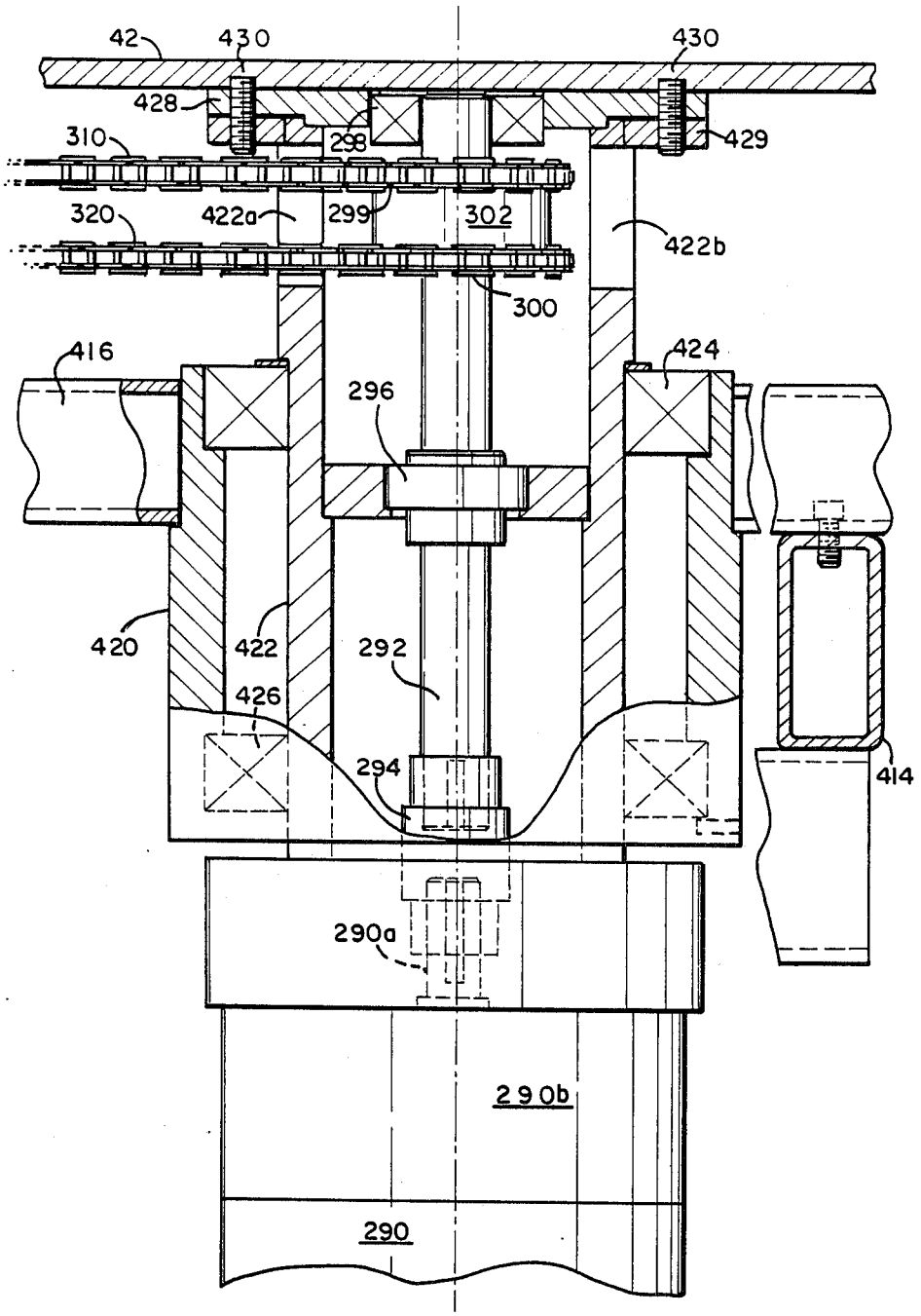
Figure 12:
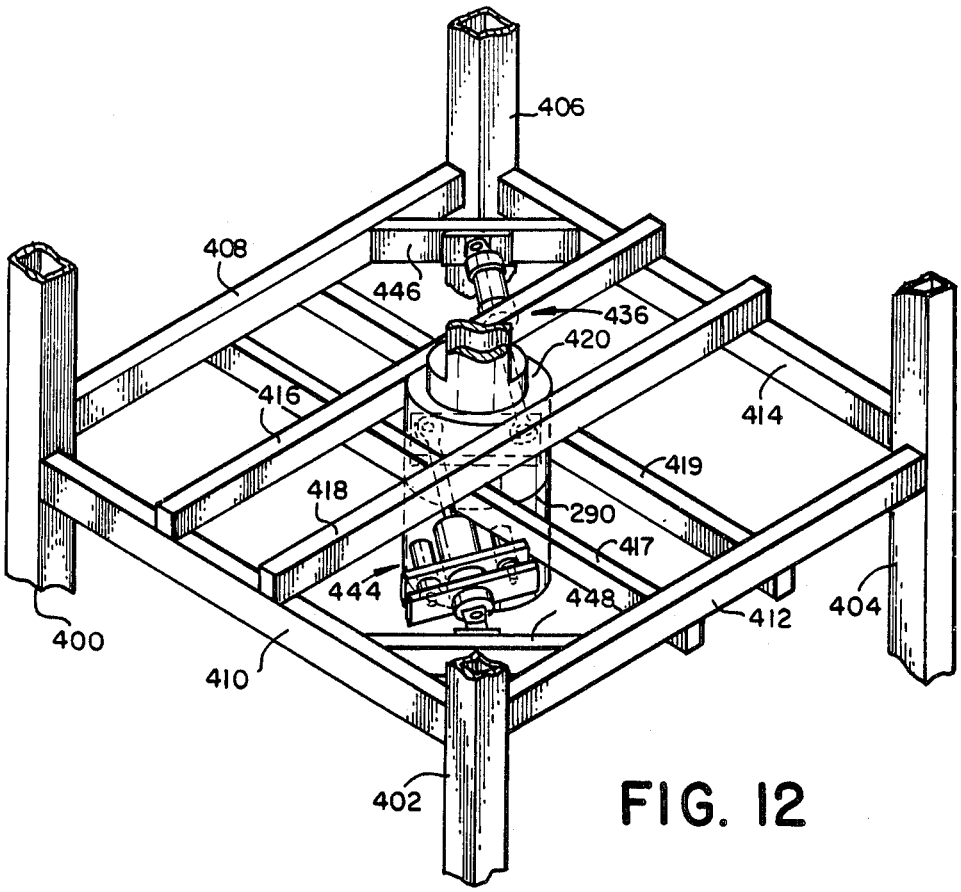
Figure 13:
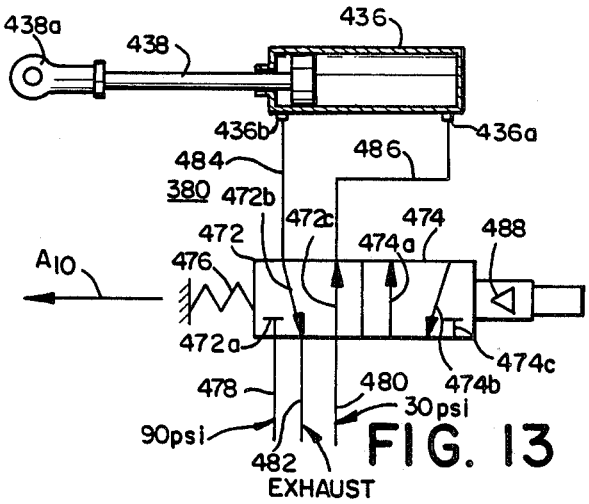

FIG. 7 shows an elevational view of the turntable assembly of FIG. 6;

FIG. 8 shows a detailed plan view of the underside of the turntable assembly shown in FIG. 1 and showing the turntable drive mechanism;

FIG. 9 shows an elevational view partially sectionalized, of the turntable drive mechanism of FIG. 8;

FIG. 10 shows a detailed sectional view of the mounting assembly for rotatably mounting the gate/-pusher drive motor;

FIG. 11 shows a sectional view of the mounting assembly of FIG. 10, looking in a direction of arrows 11—$11^1$ of FIG. 10;

FIG. 12 shows a perspective view of the portion of the stacker frame upon which the turntable and its drive assemblies are mounted; and FIG. 13 shows a simplified schematic view of the pneumatic control system utilized for controlling the air cylinder shown in FIG. 8 and which is provided for rotating the turntable.

Figure 14:
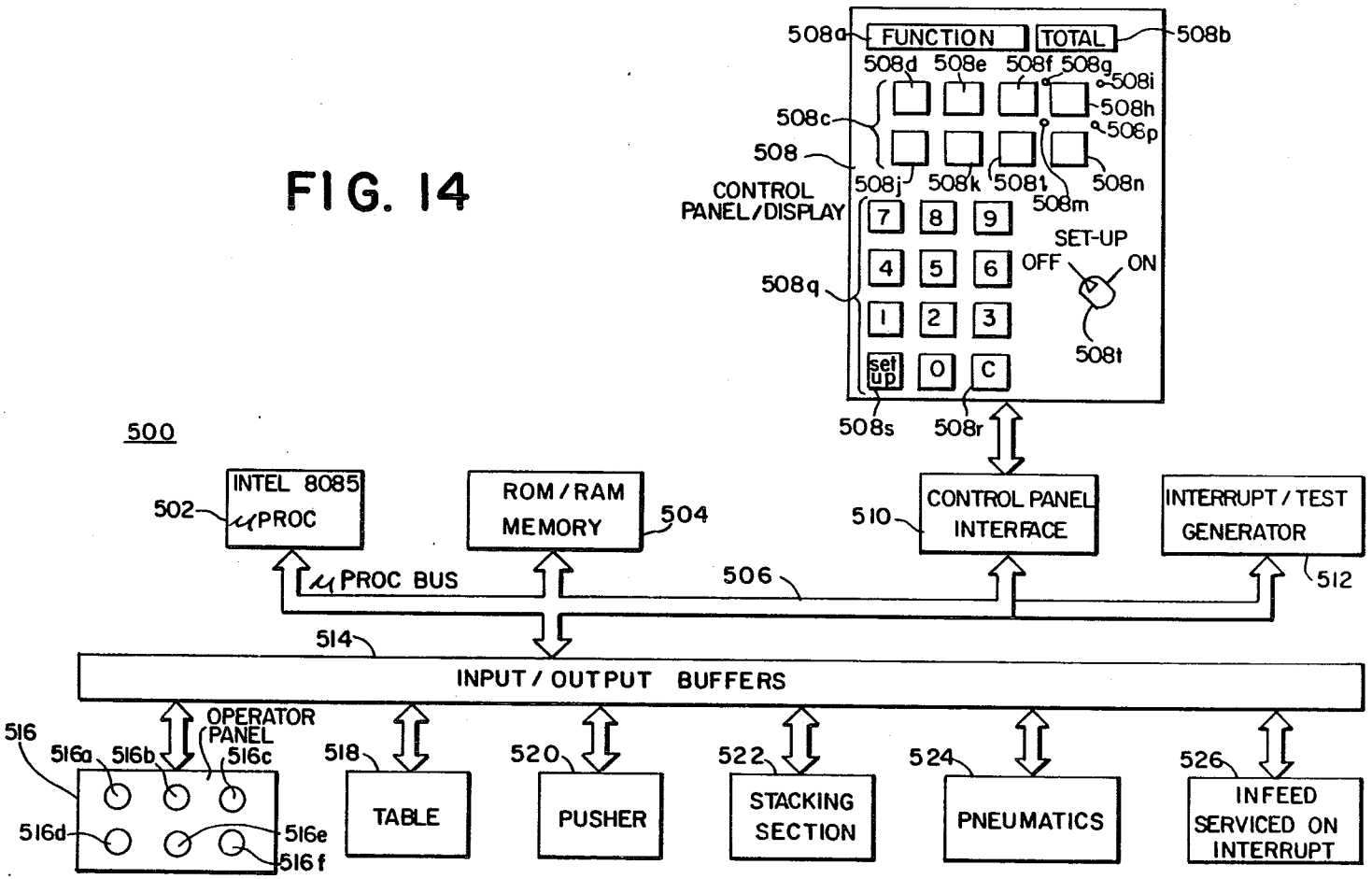

FIG. 14 is a simplified block diagram of the stacker electronic controller.

Figure 15:
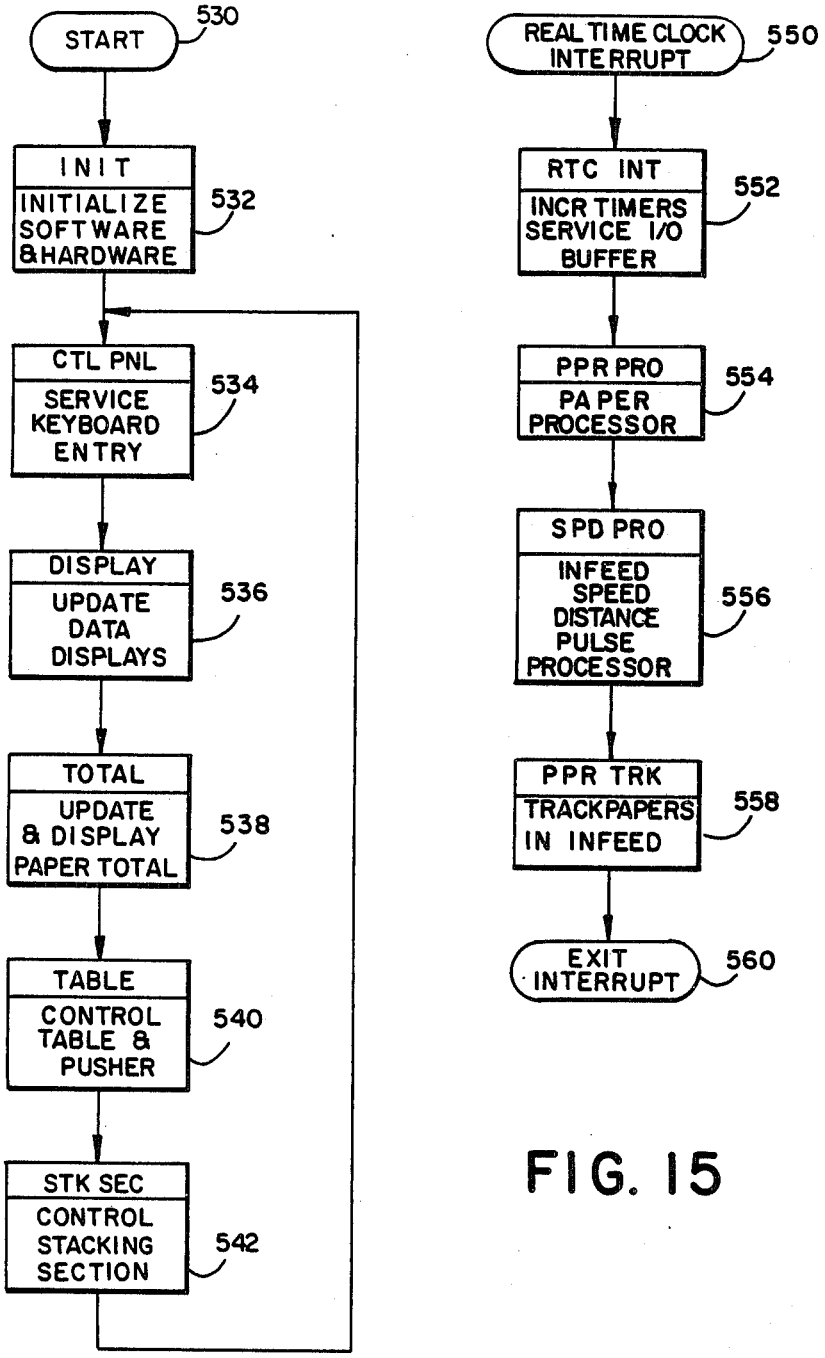
Figure 16:
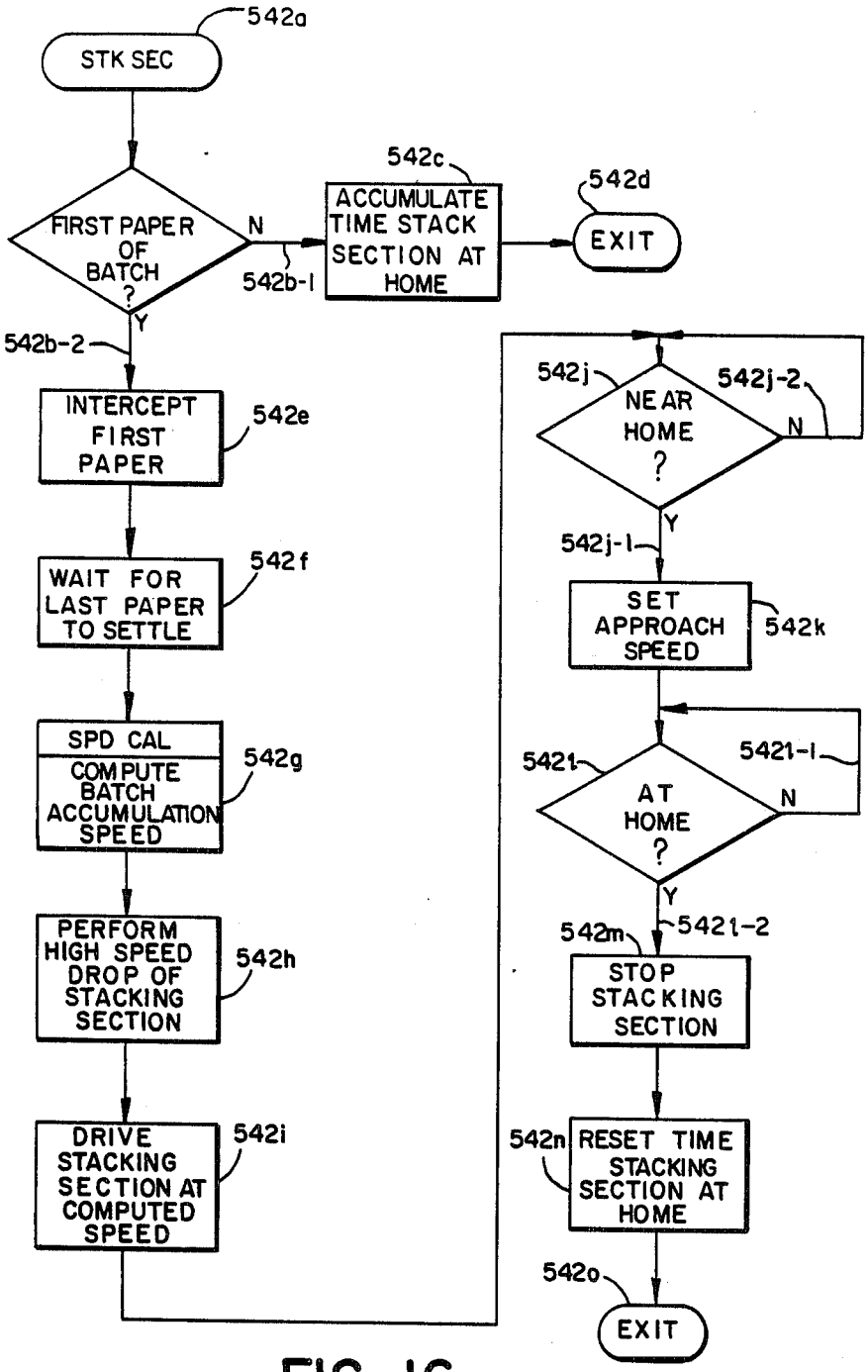
Figure 17:
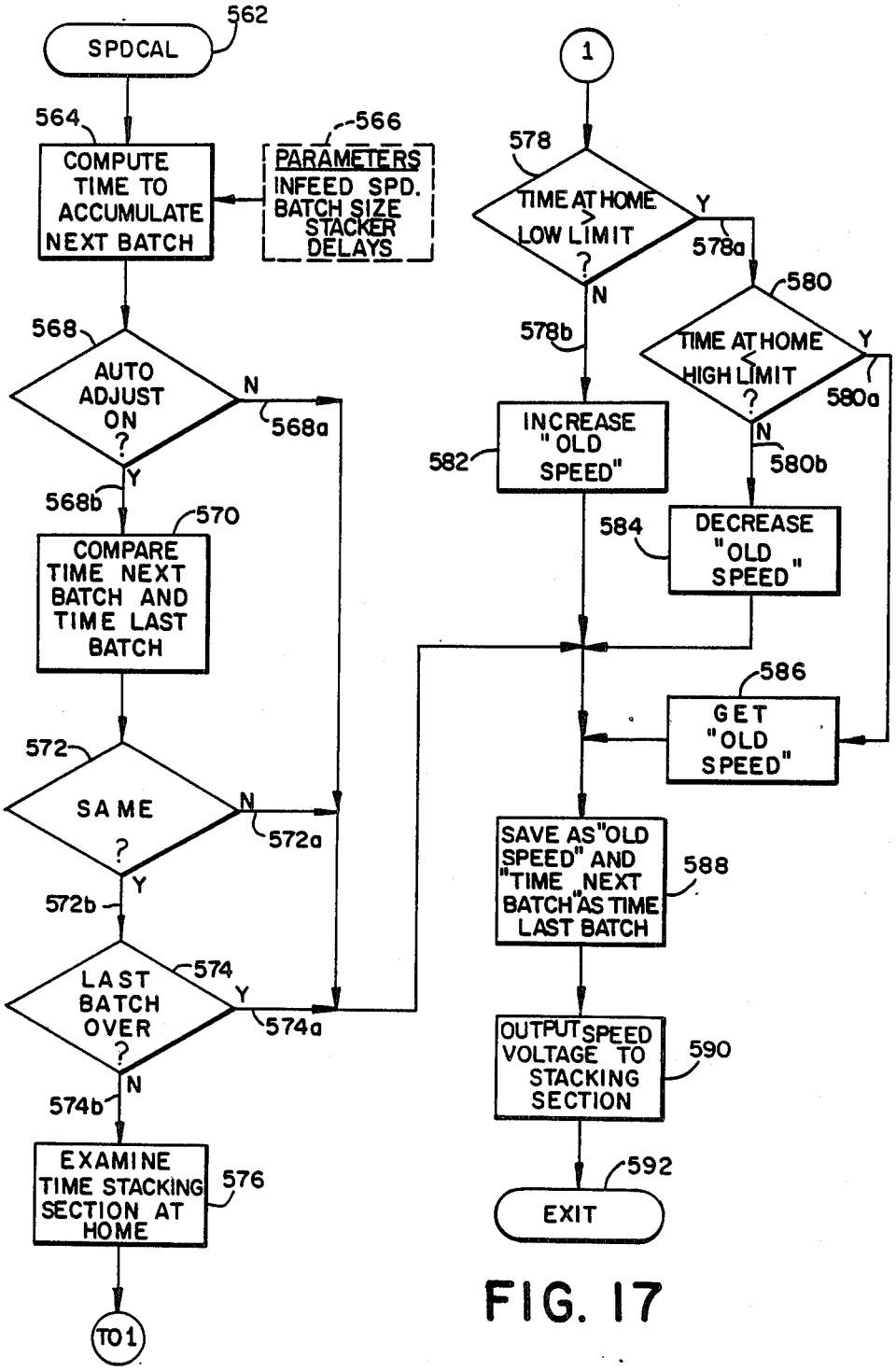

FIGS. 15, 16 and 17 are flow diagrams useful in explaining the operation of the controller of FIG. 14.

Figure 18:
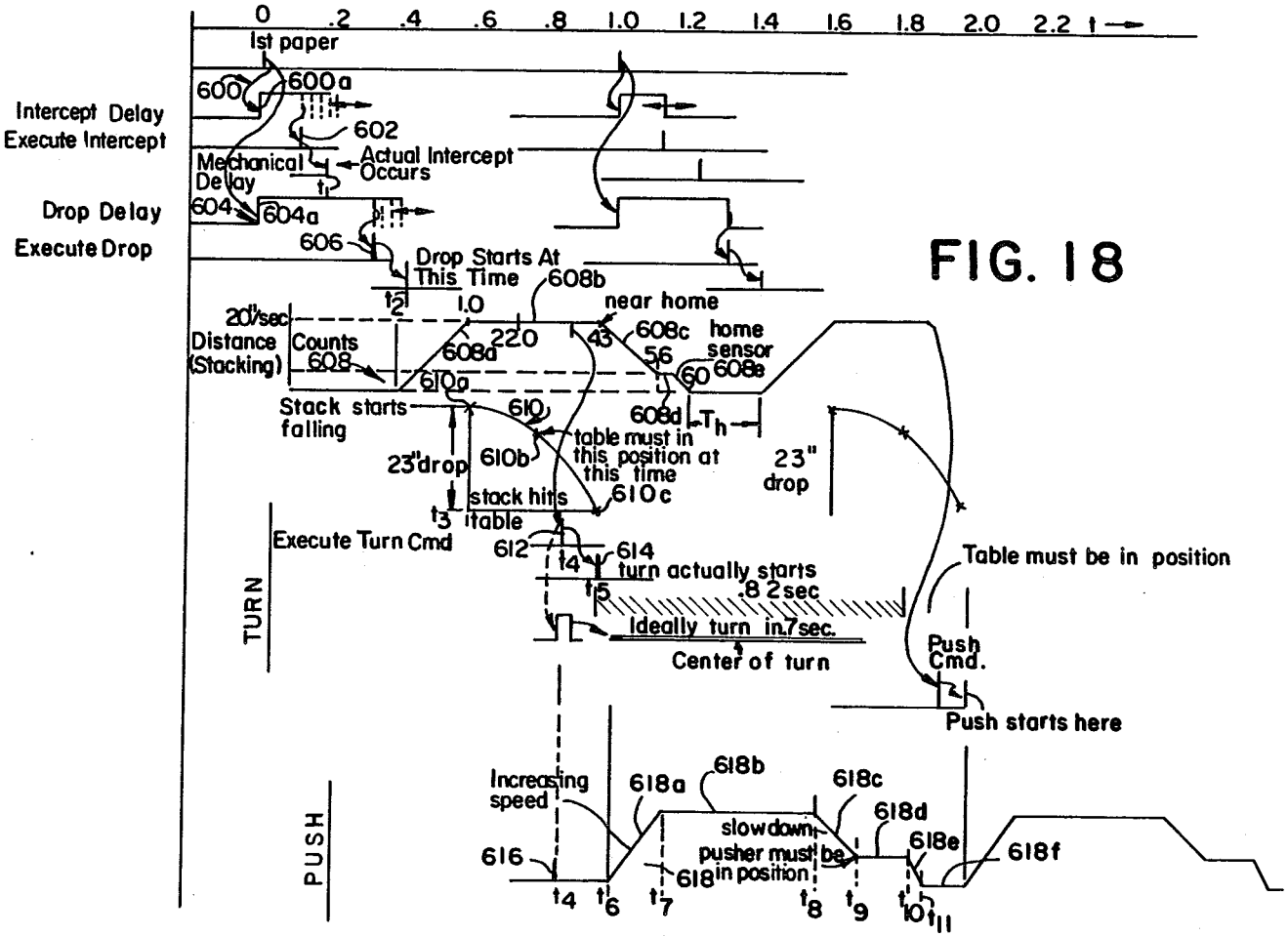

FIG. 18 is a diagram showing the manner in which the stacker turntable, pusher and stacking sections operations are interrelated.

DETAILED DESCRIPTION OF THE INVENTION

FIG. 1 shows a simplified view of a stacker 10 embodying the principals of the present invention and having a frame 12 supporting each of the stacker sections including the in-feed section 14, stacking section 30 and turntable section 40. Frame 12 is supported upon wheels 11 to facilitate its movement.

The in-feed section 14 cooperates with a conveyor assembly 15, only a small portion of which is shown in FIG. 1 for purposes of simplicity, the conveyor section 15 conveying a signature stream 17 comprised of folded signatures S arranged in an overlapping stream and delivered to stacker 10 with the folded edges F constituting the leading edges of the signatures.

The stacker in-feed section 14 is of substantially conventional design and is comprised of an upper conveyor section 16 and two successively arranged lower conveyor sections 18 and 20. Conveyor section 16 is typically comprised of a plurality of wire belts 16*b* entrained about rollers 16*a* and 16*c*. Similarly, sections 18 and 20 are comprised of wire belts 18*b*, 20*b* entrained about rollers 18*a*, 18*c* and 20*a*, 20*c* respectively.

Conveyor section 18 and left hand end of conveyor section 16 form a tapering throat into which signatures from the conveyor section 15 are introduced. Conveyor section 20 and the right hand portion of conveyor section 16 are preferably of a V-shaped configuration to impart a similar shape to incoming signatures which serves to stiffen the signatures and thereby facilitate the handling and courting operations.

The leading edges of signatures are sensed by a sensor 24 mounted upon an adjustable mounting assembly 22 which adjustably positions the sensor 24 relative to the incoming signature stream so that the sensing element, (not shown for purposes of simplicity) which may be of either a contact or non-contact type, senses the presence of the folded leading edge F of each signature to develop a pulse which is counted by suitable counting means for purposes of forming stacks of a predetermined count.

The signatures thereafter move out of engagement with conveyor sections 16 and 20 and pass beneath a guide bar 21 toward stacking section 30.

Stacking section 30, which will also be described in greater detail hereinbelow, especially with regard to its novel features, is comprised of a plurality of stacking platform assemblies 36, $36^1$ and $36^{11}$ coupled to a pair of drive chains, as will be more fully described in connection with FIGS. 2–4, so as to follow a substantially oval shaped path which path includes an intercept ready position wherein the stacking platform is located just above guide bar 21 in readiness for intercepting the incoming signature stream. Once the stacking platform moves into the signature stream, it collects signatures thereby diverting the signatures from being delivered to the stacking platform previously receiving signatures.

After a predetermined delay, the stacking platform which has just interposed the signature stream is then moved downwardly along a substantially linear path as it collects signatures. The stacking platform ultimately arrives at the position occupied by platform $36^1$ whereupon the stacking platform effectively rotates through 180° during which time the signature stack collected thereon drops downwardly toward turntable assembly 40.

The stacking platform $36^1$, for example follows the lower curved portion of the oval shaped path and moves upwardly along the rear portion thereof and around the top curved portion to ultimately return to the intercept ready position in readiness for intercepting the signature stream when the count of signatures on the stacking platform presently collecting signatures reaches the desired count.

In the preferred embodiment, the stacking section is provided with three stacking platforms arranged at equally spaced intervals about the aforementioned oval shaped path. The platforms are so arranged that only one platform receives signatures while the second platform is about to deliver its signature stack to the turntable assembly, the remaining stacking platform having previously delivered its signature stack is returning to the intercept ready position.

The in-feed section 14 and the stacking section 30 are provided with variable speed drive motors 31 and 32 for operating their respective sections. THe output of motor 31 is coupled through gear box 33 and drive chain 35 to the roller assemblies and belts of the in-feed section 14. Variable speed drive motor 32 is coupled through gear box 34 and a drive chain to be more fully described upon a consideration of FIGS. 2 and 4 for driving the aforementioned pair of drive chains which drive the stacking platforms 36 through 36[11] coupled thereto.

The turntable assembly 40 is comprised of a circular shaped turntable 42 having first and second moveable signature supporting structures 44 and 46 each further including a plurality of gate/pusher elements 45 and 47 respectively for respectively holding the signature stacks upright and preventing their displacement during high speed turntable rotation and thereafter for pushing a completed signature batch from the turntable on to an adjacent conveyor after a batch has been completed.

The turntable is rotatably supported upon the stacker frame including frame cross-braces 52 which support the mounting assembly 50. An air operated cylinder assembly 48 cooperating with a shock absorbing assembly 49 is utilized to rotate the turntable through one-half revolution. Assembly 50 includes a variable speed servo motor 51 for operating the moveable support assemblies 44 and 46.

The stacking section, shown in FIG. 1, is shown in greater detail in FIGS. 2 through 4 and is comprised of a pair of cam plates 54, 54' only one such plate 54 being shown in FIGS. 1, 2 and 3 for purposes of simplicity. It should be understood that the cam plates are substantially identical in configuration and function. Considering especially FIG. 3, the upper end of cam plate 54 is provided with an elongated slot **54*a* terminating in a curved inner end 54*b*. Upper shaft 56 is positioned within the slot 54*a* of each of the cam members and is free-wheelingly supported upon each of the cam plates by a bearing 58. The lower end of cam plate 54 is provided with a substantially rectangular shaped opening 54*c* having curved corners. Opening 54*c* receives a rectangular shaped block 60 having an opening for receiving one end of lower shaft 62 which is urged downwardly and away from shaft 56 by gas spring 64 whose upper end 64*a* is provided with an eyelet 64*b* for receiving pin 66 which is secured to cam plate 54 to pivotably mount gas spring 64 to cam plate 54. The lower end of gas spring 64 is provided with a piston rod 64*c* whose free end extends into a recess 60*b* in member 60 to normally urge member 60 and lower shaft 62 downwardly. Member 60 is secured to shaft 60 by means of set screw 63**.

A sprocket 68 is secured to upper shaft 56 and a sprocket 70 is secured to bearing 72 which in turn is secured to lower shaft 62. A drive chain schematically represented by dashed line 74 is entrained about sprockets 68 and 70. Gas spring 64 urges shaft 62 downwardly and away from shaft 56, maintaining drive chain 74 under the proper tension. It should be understood that the right hand ends of shafts 56 and 62 are provided with similar sprockets coupled to rotate in synchronism by a similar drive chain and maintained under proper tension by a like gas spring.

Upper shaft 56 is rotated by means of motor 32 whose output is coupled to gear box 34 having an output shaft **34*a*. A sprocket 76 is mounted on output shaft 34*a*. A sprocket 78 receives drive from sprocket 76 by means of a chain 80 entrained about sprockets 76 and 78. Sprocket 78 imparts rotation to upper shaft 56. A plate 82 welded to vertical member 84 forming part of the stacker frame supports the gear box 34 and motor 32, gear box 34 being secured to plate 82 by fasteners 83 and motor 32 being joined to gear box 34** by suitable fastening means (not shown).

The cam plate 54 is spaced inwardly from frame member 84 and is secured thereto by rod 86 whose left hand end is secured to frame 84 by support plate 88. The left hand end of rod 86 extends into opening **88*a* in support plate 88. Fastening members 89 secure support plate 88 to frame member 84. The right hand end of rod 86 is secured to cam plate 54 by means of threaded fastener 91**.

The upper end of cam plate 54 is secured to the stacker frame by means of an elongated support rod 90 having its upper end secured to an upper cross-brace 92 and having its lower end joined for example by welding to a short strut 94 whose opposite end is welded to a plate 96 whose lower end is secured to a rod 98 for joining the plate 96 at its lower end to a stacker frame member (not shown for purposes of simplicity) by fastening member 99.

A track member 100 is welded to plate 96 and is further provided with upper and lower brackets 102 and 104 which are welded to track 100 and are secured to cam plate 54 by fasteners 103 and 105.

The pair of drive chains provided as part of the stacking section for driving the stacking platforms have coupled thereto the pivot assemblies for each of the stacking platforms. FIG. **4*b* shows an enlarged detailed view of one such pivot assembly 110 which is comprised of a pair of blocks 112 and 114 each having an opening 112*a* and 114*a* respectively for receiving a shaft 116 therethrough. Roll pins 113 and 115 are provided to rigidly secure shaft 116 to blocks 112 and 114. The surface 112*b* and 114*b* of blocks 112 and 114 are welded to members 74*a* and 75*a* forming integral link components of the two stacking section drive chains 74 and 75**.

Each block 112 and 114 is provided with an additional opening **112*c*, 114*c* for respectively receiving a pin 118, 120**.

A pair of elongated arms 122, 124 are each provided with first openings **122*a*, 124*a* for receiving shaft 116. Collar members 126 and 128 also receive shaft 116 through their central openings and are positioned against an adjacent surface of an associated arm 122, 124. Each collar is provided with a threaded opening receiving a set screw 127, 129 for retaining the axial position of each of the collars and each of the arms 122, 124 along shaft 116**.

A pair of helical torsion springs 130, 132 are respectively arranged between blocks 112 and 114 and arms 122 and 124, as shown. The free ends **130*a* and 132*a* of springs 130 and 132 bear against pins 118 and 120 respectively. The opposite free ends 130*b*, 132*b* of springs 130 and 132 bear against pins 134, 136 secured within suitable openings 122*b*, 124*b* in arms 122 and 124** respectively.

Arms 122 and 124 are further provided with openings **122*c*, 124*c* for receiving shaft 138 which is locked to arms 122 and 124 by means of roll pins 139 and 140. The free ends of shaft 138 support cam follower rollers 142 and 144 secured to shaft 138 by means of threaded members threadedly engaging tapped openings 138*a*** and 138*b*. Considering the arrangement shown in FIG. 2, chain link 74*a* is shown being coupled to block 112 while arm 122 and hence shaft 138 is normally urged in the counterclockwise direction by springs 130 and 132 to normally urge the cam follower rollers 142 and 144 against the cam surface of the cam plates, such as cam plate 54. Considering the cam surface of cam plate 54 in greater detail, cam follower roller 142 is shown in dotted fashion moving along and thereby occupying various positions along the cam surface. As will be noted, the back surface portion 54*d* of cam plate 54 is substantially straight. The upper end 54*e* is curved and merges with a straight portion 54*f* along the front edge thereof. Cam plate 54 is further provided with a substantially rectangular shaped opening 54*g* immediately beneath the straight cam surface portion 54*f*. A second elongated straight cam portion 54*h* extends downwardly from rectangularly shaped slot 54*g* where it merges with the sharply curved portion 54*i* which merges with a curved portion 54*j* having a substantially greater radius of curvature. The cam follower roller 142 is urged to follow the surface of cam plate 54 as the drive chains 74 and 75 move the stacking platforms about the oval shaped path formed by the drive chains.

Slot 54*g* receives the intercept assembly comprised of an intercept arm or claw 146 and a piston assembly 148. The intercept arm 146 comprises a mounting portion 146*a* with openings 146*f* for receiving suitable fastening members for joining intercept arm 146 to the housing portion 149 of piston assembly 148.

An integral projection 146*b* extends outwardly from and is perpendicular to base portion 146*a*. The free end 146*c* of arm 146*b* extends outwardly from and is perpendicular to arm 146*b* to form the embracing arm 146*c* which is tapered at 146*d*. Noting, for example, FIGS. 5*a* and 5*d*, cam follower roller 144 is arranged to move downwardly in the direction of arrow 151 into the recess 146*e* formed by base portion 146*a*, projecting arm 146*b* and tapered embracing arm 146*c*. Tapered surface 146*d* serves to guide the cam follower roller 144 into recess 146*e*. The piston housing 149 is moveable and is slideably mounted within recess 54*g* in cam plate 54, the upper and lower surfaces 149*a* and 149*b* of housing 149 slideably engaging upper and lower linear surfaces 54*g*-1 and 54*g*-2 of elongated slot 54*g*. The vertically aligned side surfaces 149*c* and 149*d* slideably engage mounting brackets 150, 151 and 152, 153 respectively. Piston 154 is secured to mounting block 156. Threaded adjustable member 158 provides for adjustment of the axial position of piston 154. Air under pressure is selectively introduced into port 149*f* urging housing 149 and intercept arm 146 in the direction shown by arrow 162 of FIG. 5*d*. Air under pressure is selectively introduced into port 149*e* to urge housing 149 and hence intercept arm 146 in the direction shown by arrow 163.

As will be described in greater detail hereinbelow, the next stacking platform to intercept the signature stream is moved about curved portion 54*e*, of cam plate 54 (see FIG. 3) and moves downwardly off linear portion 54*f* so as to enter into the recess 146*e* in order to be embraced by intercept arm 146. At this time, the motor 32 is halted to halt the movement of the stacking platforms so that the stacking platform next to intercept the signature stream has its follower cam embraced by intercept arm 146. It should be understood that both cam follower rollers 142 and 144 are positioned within associated interceptor arms. At this time, the signature supporting platform, which is comprised of stacking blades 164 secured to the undersides of arms 122 and 224 (see FIG. 4*b*) which have their free ends 164*a* extending above the guide plate 21 as shown best in FIG. 2. Stacking platform 36 reaches the intercept ready position before the stacking platform $36^1$ has received the desired number of signatures.

As soon as the proper number of signatures has been delivered to the stacking platform $36^1$, air under pressure is introduced into port 149*e* of cylinder housing 149 moving interceptor arm 146 and hence cam follower rollers 142 and the stacking blades 164 downwardly from the position occupied with the tips 154*a* of stacking blades above guide plate 21 to the dotted line position $164^1$ shown in FIG. 2.

The cam follower roller 142 is now in the position shown by dotted circle $142^1$ in FIG. 3. After a predetermined drop delay (to be more fully described) variable speed motor 32 is energized in a ramp fashion (i.e. by a ramp signal) causing the drive chains and hence the cam follower roller 142 to accelerate downwardly from the position $142^1$ wherein the cam follower roller is embraced by the intercept arm 146, so that the cam follower roller moves out through the open bottom of interceptor arm 146 and into the guide path defined by the straight cam surface 54*b* of cam plate 54 (see FIG. 3) and the cooperating surface of track 100.

The cam surface 54*h* of the cooperating surface of track 100 collectively prevent the stacking platform 36 from experiencing any swinging movement as the stacking platform moves downwardly through the signature receiving and stacking region.

FIG. 4*a* shows the manner in which the position of each stacking platform is continuously monitored. As shown in FIG. 4*a*, a gear 170 having a plurality of gear teeth (60 teeth in the preferred embodiment) about its periphery is mounted to rotate upon shaft 56. Gear 170 is secured to shaft 56 by integral collar 172 and set screw 173. A substantially U-shaped bracket 174 is secured to cam plate 54 by fasteners 175 and supports first and second sensors 176 and 178 threadedly engaged by tapped apertures within mounting bracket 174 and secured against linear movement by fasteners 177 and 179.

The gear teeth of gear 170 pass sensor 176 which may, for example, be a Hall effect sensor, for generating pulses, each pulse representing the passage of one gear tooth. Gear 170 is provided with a single opening 170*a* radially displaced from its axis of rotation. The longitudinal axis of sensor 178 is positioned a distance from the axis of rotation of gear 170 which distance is equal to the distance between the axis of rotation of gear 170 and the central axis of opening 170*a* whereupon movement of opening 170*a* across the sensing end of sensor 178, which may also be a Hall effect sensor, causes the development of a pulse which senses the home position of gear 170. The angular orientation of gear 170 about shaft 156 is adjusted so that the home position is substantially aligned with sensor 178 at the time that the cam follower roller 142 of a stacking platform enters into interceptor arm 146.

The pulses generated by sensors 176 and 178 are provided to a microprocessor, to be more fully described, which utilizes the signals developed to control the operation of the variable speed motor 32 and hence the stacking platforms 36 through $36^{11}$.

More specifically, the gear teeth are counted and when the count reaches a predetermined value which indicates that the stacking platform is a small predetermined distance from the intercept position, the microprocessor significantly drops the speed of variable speed motor 32 so that when the cam follower roller 142 enters into the recess **146*e* in intercept arm 46**, the abrupt halting of the motor from a reduced "near home" speed results in bringing the motor to an accurate halt at the desired position due to the slow down of the stacking platform to an "approach" speed prior to abruptly halting the stacking platform.

The gear teeth are also counted after the intercept arm 146 moves the stacking platform into position to intercept the incoming signature stream to track the location of the stacking platform. The computer develops a ramp signal which is applied to variable speed motor 32 to accelerate the motor up to the desired speed. The computer converts the ramp signal to a constant level signal after a predetermined number of gear teeth have been counted.

FIG. **4*a* shows another alternative arrangement for slideably mounting the intercept arm cylinder housing 149. A first arm 182 is positioned against the left hand face of cam plate 54. A bottom block 184 and side block 186 are secured by fastener 188 to block 182 as well as being secured to cam plate 54. A top block 190 is secured to the right hand surface of cam plate 54 by fastener 191. Low friction bearing strips, 192, 194 and 196, preferrably formed of a material having a low coefficient of friction, are arranged between housing 149 and blocks 184, 186 and 190 to provide a low friction sliding surface for facilitating the smooth sliding of housing 149**.

Guide plate 21 shown, for example in FIG. 2, has a thin flexible plate 198 secured near the free right hand end thereof. A sensor 200 is secured within a threaded opening in stationary guide plate 21. Flexible plate 198 will move upwardly in the event that a cluster of signatures begins to form in the region between stacking blades 164[1] and flexible plate 198 to provide a signal indicating the creation of a jam. This signal may, for example, be utilized to operate cylinder assembly 28 shown in FIG. 1 causing conveyor section 20 to swing clockwise about a pivot P to allow incoming signatures to drop to the floor and hence be diverted from the stacking section 30 to prevent any of the stacker components from being damaged.

The signature count is developed by accumulating pulses generated by signature sensor 24. When the appropriate number of signatures have been counted and the appropriate delay interval has been provided for taking into account the time required for the leading edge of a signature counted by signature sensor 24 to reach a point below the free end of the stacking blades 164 of stacking platform 36 so that the last signature of the count will be collected on the proper stacking platform, and further taking into account the inherent delay of the interceptor arm cylinder assembly 148, a control valve (not shown) is caused to introduce air under pressure into air cylinder 148 to move interceptor arm 146 and thereby cause the stacking platform 36 in the intercept ready position to swing downwardly to the intercept position, after the leading edge of the last signature to be collected by stacking platform 36[1] passes the tips of the stacking platform, to intercept and collect the next signature in the signature stream and a predetermined number of signatures thereafter.

The turntable assembly 40 is comprised of a unitary circular turntable 42 formed of a suitable metallic material, the turntable being rotatably mounted in a manner to be more fully described. A pair of moveable support assemblies 220 and 222 are each arranged upon the turntable 42, and extend upwardly therefrom and are arranged in spaced parallel fashion relative to one another to define a pair of upright side walls for receiving stacks of signatures therebetween. Since each of these assemblies is substantially identical to one another in both design and function, only one of said assemblies will be described herein in detail for purposes of simplicity.

Noting especially FIGS. 6 and 7, moveable side wall assembly 220 is comprised of lower and upper plates 224, 226 maintained in a spaced parallel fashion by means of a supporting frame comprised of a pair of horizontally aligned crosspieces 228, 229 for securing vertically aligned cross-pieces 230, 232 and 234 thereto. FIG. 7 shows an elevational view of the frame comprised of these cross-pieces while FIG. 6 shows the top plan view showing the manner in which the horizontal cross-pieces 228 and 229 are joined to vertical cross-pieces 230 through 234. The horizontal cross-pieces 228 and 229 are provided with slots **228*a*, 228*b*, 228*c* and 229*a*, 229*b* and 229*c* for receiving the end portions of the vertically aligned plates 230, 232 and 234 respectively. Slot 229*c* has been removed from FIG. 6 for purposes of exposing elements arranged therebeneath. Fasteners 231, 233 and 235 join cross-piece 228 to the vertically aligned frame pieces 230, 232 and 234. Similar fastening means secure cross-piece 229** to these vertically aligned frame members.

Frame member 224 is secured to turntable 42 by a plurality of fasteners 237. Vertically aligned frame members 230, 232 and 234 are joined to turntable 42 and lower plate 224 by means of fasteners 239.

The sprocket 240 (to be more fully described) couples drive to the pair of chains 270, 268 supported by the aforementioned frame assembly through coupling 242 rotatably journalled within bearing 244. The coupling assembly 242 further includes shaft 246 having sprocket 248 mounted to its lower end and sprocket 250 mounted to its upper end. The upper end of shaft 246 is journaled within bearing 252 arranged within upper plate assembly 226.

A pair of idler sprockets 254 and 256 are secured to idler shaft 258 journaled within bearings 260 and 262.

Upper and lower gas spring assemblies 264 and 268 urge shaft 258 toward the left relative to FIG. 7. An upper drive chain 268 is entrained about sprockets 250 and 256. A lower drive chain 270 is entrained about sprockets 248 and 254. Drive chains 268 and 270 have been shown in schematic fashion for purposes of simplifying FIGS. 6 and 7.

Fastening means 271 and 273 secure the right hand ends of gas springs 264 and 266 to their respective mounting plate assemblies 226 and 224. The pistons **264*a* and 266*a* of gas springs 264 and 266 urge collars 272 and 274 and hence shaft 258 to the left to maintain drive chains 268 and 270** under the proper tension.

A plurality of elongated slats 276, only one of which is shown in FIG. 7 are secured near their upper and lower ends to the upper and lower drive chains 268 and 270, respectively. Each link of the drive chains 268 and 270 is provided with an outwardly extending integral tab 275 having an opening for receiving a fastener 277 for securing each slat to the upper and lower chains. THe slats 276 are arranged in closely spaced parallel fashion to collectively form a moveable wall. The three gate/pusher assemblies, 280, 280[1] and 280[11] are arranged at equispaced intervals along the moveable wall and are affixed to their upper and lower ends to drive chains 268 and 270 by fastening means 277. Since all the gate/pushers are substantially identical, for purposes of simplicity only gate/pusher 280 will be described in detail. Considering FIG. 6, the gate/pusher 280 is comprised of a substantially U-shaped elongated resilient (i.e. rubber or rubber-like) portion 281 secured to an elongated mounting or base portion 282 having a special link 284 forming an integral part of its associated drive chain and having a tapped opening coaligned with an associated opening in base member 282 for receiving a threaded fastener 281*a* to secure the base member and hence the gate/pusher to the chain. Noting FIG. 7, it can be seen that the height of each gate/pusher is greater than the slats 276. The rear edges of the slats 276 and gate pushers 280 through $280^{11}$ slideably engage the adjacent surfaces of plates 228 and 229 to maintain those slats presently positioned between the center lines of the sprockets 250, 262 and 248, 254 in a straight line.

The pair of moveable side wall assemblies 220, 222 are moved when it is desired to push a completed compensated (or uncompensated) batch off of the turntable 42 and onto an adjacent conveyor (not shown). The power train for accomplishing this movement is comprised of a combination servo motor and gear reducing assembly 290 shown for example in FIGS. 10 and 11, having its output shaft 290*a* coupled to intermediate shaft 292 by flexible coupler 294. Intermediate shaft 292 is journaled within bearings 296 and 298 arranged at spaced intervals at the intermediate and upper end portions, respectively of shaft 292. A pair of sprockets 299, 300 are joined to one another through common cylinder 302 and are mounted upon shaft 292.

As will be described in detail hereinbelow, each of the moveable side wall assemblies 220 and 222 is driven by separate, independent drive chains respectively coupled with and driven by the upper and lower sprockets, 299, 300. For example, moveable side wall assembly 220 (see FIG. 6) is provided with sprocket 240 which lies in the same horizontal imaginary plane as sprocket 299. A drive chain 310 is entrained about upper sprocket 299; the upper sprocket 312 of a pair of sprockets 312, 314 integrally joined to one another and mounted to rotate about common axis 315; sprocket 306 and sprocket 240. Assuming that sprocket 299 rotates in the direction shown by arrow $A_1$ shown in FIG. 6 the drive chains forming the moveable side wall assembly 220 will move in the direction shown by arrow $A_2$. It should be understood that all of the sprockets 298, 312, 306 and 240 lie in the same imaginary horizontal plane.

Second drive chain 320 is entrained about lower sprocket 300 and lower sprocket 314, as well as sprockets 316 and 318. It should be understood that sprockets 300, 314, 316 and 318 all lie within the same imaginary horizontal plane. Assuming rotation of sprockets 299 and 300 in the direction shown by arrow A1, the drive chains making up moveable wall assembly 222 will move in the direction shown by arrow $A_3$ which is the same direction as arrow $A_2$. Thus, the pushers $280^{11}$ of moveable wall assemblies 220 and 222 cooperate to push a compensated (or uncompensated) signature batch supported on turntable 42 between the two side wall assemblies in the direction shown by arrows $A_2$ and $A_3$ onto an adjacent conveyor (not shown for purposes of simplicity) for subsequent handling and to place the turntable assembly 40 in readiness for the formation of the next compensated bundle.

Whereas each of the sprockets 240, 316, 299–300 and 312–314 are mounted to rotate about stationary axes, sprockets 306, 318 are rotatably mounted upon swingable arms 324, 326 swingable about pivots 328, 330 and having their free ends pivotally secured to the pistons 332*a*, 334*a* of gas springs 332, 334 whose opposite ends are swingably mounted to turntable 42 by brackets 336, 338, respectively.

In operation, when the servo motor 290 is abruptly energized and thereby abruptly accelerates the aforementioned groups of sprockets and drive chains, the sprocket 318 tends to be urged in the direction shown by arrow A4. Likewise sprocket 306 tends to be urged in the direction shown by arrow $A_5$ when sprockets 299, 300 are rotated in a direction opposite that indicated by arrow $A_1$. Thus the gas spring biased sprockets 306 and 318 prevent start-up of the moveable side walls in a jerky fashion regardless of the direction of rotation, it being understood that motor 290 is a bi-directional motor.

A pair of elongated tapered bars 346, 348 are mounted upon turntable 42 in spaced parallel fashion and are parallel with the moveable side walls as shown best in FIG. 6. The bars 346, 348 support the bottom signature so that it is maintained a spaced distance above the top surface of turntable 42 to prevent the bottom signature and hence any signatures resting upon the bottom signature from becoming wedged beneath the gate/pusher arms 280 and/or the slots 276. As can best be understood from a consideration of FIG. 6 four of the six gate/pusher assemblies cooperate with the moveable side walls to hold a compensated signature batch upright and prevent the signature batch from toppling during the time that the turntable 42 is rapidly rotated through one-half revolution. The gate/pusher assemblies then perform their "pushing" function to urge the completed compensated (or uncompensated) batch in either direction off of the turntable and on to an associated conveyor (not shown) for subsequent handling, such as, for example, tying of the bundle.

A plurality of air nozzle assemblies 355 are arranged along the upper surface of turntable 42. Each assembly 355 is comprised of a ball 355*a* arranged within an opening 355*b* and maintained in sealing relation to the opening by means of air under pressure applied to each assembly to prevent the escape of air through opening 355*b*. In the event that a signature comes into contact with one of the balls 355*a* and pushes the ball downwardly, at least a portion of the opening 355*b* becomes unsealed allowing air under pressure to escape. The escaping air forms a film between the bottom surface of the signature and the top surface of the turntable, causing the signature to "float" on the film of air thereby facilitating its sliding movement off of the turntable.

The bi-directional servo motor 290 is under control of a microprocessor to be more fully described. The microprocessor energizes motor 290 at the proper time and with the proper polarity signal. Three sensors, including a pair of pre-home sensors 360, 362 and a home sensor 364, which sensors are preferrably proximity sensors such as for example Hall effect devices or the like, are utilized to halt motor 290 at the proper time. Assuming that the moveable walls are to be moved in the directions shown by arrows A2 and A3, sensor 362 will be enabled so that when gate/pusher assembly $280^1$ moves over sensor 362 a signal will be developed by sensor 362 indicating that the moveable wall assembly is nearing completion of its interval of operation. This signal is utilized to reduce the speed of motor 290 to a value of the order of 15 percent of its normal operating speed whereby gate assembly 280[1] moves at a significantly reduced rate (i.e. an "approach" speed) from the position occupied by prehome sensor 362 toward the home position occupied by proximity sensor 364. As the gate/pusher assembly 280[1] moves over proximity sensor 364, motor 290 is abruptly halted, preferably utilizing a dynamic braking technique, whereupon gate/pusher 280[1] occupies the position previously occupied by gate/pusher 280, while gate/pusher 280 and 280[11] now occupy the positions previously occupied by gate/-pusher assemblies 280[11] and 280[1], respectively. The gate/pushers 280 through 280[11] utilized moveable side wall assembly 220 are indexed in a similar fashion. Since the chain assembly drives the moveable side wall assemblies through substantially the same distance, only one set of pre-hole sensors 360, 362 and home sensor 364 need be provided.

The turntable 42 is further provided with three brackets 368, 369 and 370 which are spaced apart at 90 degree intervals about turntable 42 and comprised of bracket arm 368*a*, 369*a* and 370*a*. Arm 368*a* has one steel plate 368*b* mounted in an upper position; arm 369*a* has two steel plates at upper and lower positions; and arm 370*a* has one steel plate at a lower position. Brackets 368, 369 and 370 occupy positions of 0°, 90° and 180° respectively. A pair of proximity sensors 372, 374 are mounted in stationary fashion upon the stacker frame, sensor 372, 374 being in alignment with the upper and lower positions, respectively.

Assuming that the turntable 42 occupies the 0° position shown in FIG. 6*c* and is rotated counterclockwise, steel plate 370*a* is sensed by proximity sensor 374 while sensor 372 senses no plate to develop a signal ("0", "1") indicating that the turntable 42 is at the 0° position. Initially, the valve control assembly operates to move turntable 42 at high speed. Upon completion of one-quarter revolution, i.e. at the 90° position (FIG. 6*b*) bracket 369 having steel plates 369*b* and 369*c* moves past sensors 372, 374 which develop signals ("I", "1") to operate the valve control assembly to reduce the pressure introduced into the cylinder during the remaining 90° of the 180° revolution.

When the bracket 368 moves into alignment with sensors 372, 374 (FIG. 6*a*), the sensors develop signals ("1" "0") indicating that table is at the 180° position. Reducing the velocity of the turntable at the 90° position simplifies and assures that the turntable's accurately stopped when at the 180° position.

When rotating in the reverse direction, i.e. from the 180° position to the 0° position, sensors 372, 374 develop the signals ("1". "0" at 0°); ("1", "1" at 90°); and ("0", "1" at 180°).

The manner in which the turntable assembly is rotatably mounted within stacker 10 is shown best in FIGS. 8, 10 and 12. The stacker frame is comprised of four upright corner posts 400, 402, 404 and 406. Four cross-pieces 408, 410, 412 and 414 rigidify the stacker frame and maintain the four corner posts in spaced parallel fashion. Although all of the corner posts and cross-pieces 400 through 414 have hollow rectangular cross-section configurations as shown by the corner posts 402 in FIG. 8, any other cross-sectional configuration or type of corner post and cross-piece may be employed.

A pair of horizontally aligned cross-pieces 416, 418, arranged in spaced, parallel fashion, are secured to cross-pieces 410 and 414 by suitable fastening means and are welded to outer cylindrical housing 420 (see FIG. 11). One such cross-piece 416 is shown welded to cylindrical housing 420 and supported upon cross-piece 414.

Cylindrical housing 420 rotatably supports a second cylindrical housing 422 journaled within bearing assemblies 424 and 426 positioned between the interior wall of cylinder 420 and the exterior wall of cylinder 422.

The upper end of rotatably cylinder 422 is provided with diametrically aligned openings 422*a*, 422*b* through which chain drives 410 and 320 extend. The upper end of inner cylinder 422 is welded to an outer ring 429 which engages and is secured to a plate 428 which supports the bearing 298 for free-wheelingly mounting the upper end of intermediate shaft 292 described hereinabove.

Fasteners 430 secure plate 428 and ring 429 to the underside of turntable 42. The heads of these fasteners are flush with the top surface of turntable 42 to present a smooth, unbroken top surface which does not interfere with sliding movement of a signature across the turntable surface.

The motor assembly described hereinabove is preferably comprised of a servo motor 290 having an output shaft coupled to a planatary reduction assembly 290*b* whose output shaft 290*a* is coupled to intermediate shaft 292 through flexible coupling 294 (see FIGS. 9 and 11).

An operating cylinder 436 (see FIG. 8) having a reciprocating piston 438 is provided with pressure inlet openings 436*a*, 436*b* for the introduction of gas under pressure to operate cylinder 436. The free end of cylinder 438 is provided with eyelet 438*a* for receiving a pin 439 which swingably mounts piston 438 to a cylindrical shaped mounting assembly 440 secured to planetary gear reduction assembly 290*b* by fasteners 441 as shown best in FIGS. 9 and 10. Mounting assembly 440 is further secured to inner cylinder 422 by elongated fasteners 443.

The shock absorber assembly 444 is comprised of a substantially U-shaped mounting assembly 450 having a first end 450*a* swingably mounted to a diagonally aligned cross-piece 448 joined to the horizontally aligned crosspieces 408 and 414. The bifurcated arms 450*b* and 450*c* of mounting assembly 450 are each provided with a mounting bracket 452, 454 secured thereto by any suitable means, each bracket being adapted to position and support a hydraulic cylinder 456, 458 respectively. Each hydraulic cylinder includes a piston 456*a*, 458*a*. The free end of each piston is secured to the opposite ends of a moveable plate 460 arranged to slide within elongated slots (not shown) provided within bifurcated arms 450*b*, 450*c*. Helical springs 462, 464 surround the exposed portion of an associated piston rod 456*a*, 458*a*. A collar 465 is joined by bifurcated arms 450*a*, 450*b* and slideably receives an elongated shaft 466 which is further slideably supported by means of a second cylindrical member 468 joined to the lower ends of bifurcated arms 450*b*, 450*c* by fasteners 469. The free end of shaft 466 is provided with a eyelet 466*a* which is swingably mounted to the mounting assembly 440 by pin 467.

The rotation of the turntable 42 through one-half revolution is performed as follows:

Air under pressure (in the preferred embodiment at a pressure of 90 PSI) is introduced into inlet 436*b* of cylinder 436 causing the piston 438 to move in the direction shown by arrow A6 thereby rotating mounting assembly 440 in the counterclockwise direction as shown by arrow A7. At this time opening 436*a* is coupled to an exhaust outlet. This operation of cylinder 436 causes mounting assembly 440, inner rotatably cylinder 422 and turntable 42 to begin rotation. The turntable 42 accelerates rapidly and, as it complete one-quarter revolution, sensors 372 and 374 develop the signals ("1", "1") causing the decoupling of 90 PSI from inlet 436*b* and coupling inlet 436*b* to the exhaust outlet and decoupling inlet 436*a* from the exhaust outlet and coupling inlet 436*a* to a pressure source having a pressure of the order of 30 PSI. At the time that moveable assembly 440 moves through one-quarter revolution, piston 438 stops moving in the direction of arrow A6 and starts moving in the direction shown by arrow A8. To sustain this movement through other than just the inertia of the mechanical parts, the 30 PSI pressure source moves the turntable from the quarter turn position to the half turn position. The 30 PSI pressure source remains coupled to the air cylinder until the next turn cycle. The turntable is abruptly halted by the shock absorber assembly 444.

As assembly 440 is rotating under control of cylinder 436 and piston 438, shaft 466 is moved in the direction shown by arrow A9 which moves plate 460 causing pistons 456*a* and 458*a* to move out of their cooperating hydraulic cylinders 456 and 458.

When the moveable assembly 440 has rotated through one-quarter turn, shaft 466 stops moving in the direction shown by arrow A9 and starts to move in the direction shown by arrow A10 whereupon plate 460 and pistons 456*a* and 458*a* move in the same direction causing the hydraulic fluid within hydraulic cylinders 456 and 458 to undergo compression. The nature of the hydraulic fluid is such that after the turntable has moved through approximately 135 degrees of rotation the hydraulic cylinders are caused to rapidly decelerate mounting assembly 440 and hence turntable 42, causing the turntable to be rapidly halted after it has rotated through 180 degrees. The sensors 372 and 374 sense rotation through this angle to detect the completion of the turntable rotation through 180°.

Upon completion of rotation of the turntable through 180 degrees, pin 439 now occupies the position previously occupied by pin 467, and vice versa. Thus the next time that turntable 42 is rotated it will be rotated in the direction opposite to the direction shown by arrow A7. Turntable 42 is thus alternately rotated in the clockwise and counterclockwise direction after the delivery of the next signature stack.

The pressure coupling assembly 380 is shown in FIG. 13 together with cylinder 436 and piston 438. The pressure coupling assembly 380 is moveable assembly having integral halves 472 and 474 spring biased by spring 476 so as to normally maintain the position shown in FIG. 13. A first inlet conduit 478 is coupled to a 90 PSI pressure source. A second conduit 480 is coupled to a 30 PSI pressure source. A third conduit 482 is coupled to an exhaust vent. Assembly half 472 is provided with a sealed opening 472*a*, a one-way valve passageway 472*b* and a one-way valve passageway 472*c*. Integral half 474 is provided with a one-way valve passageway 474*a*, a second one-way valve passageway 474*b* and a sealed passage 474*c*. Conduits 484 and 486 couple selected passageways to inlets 436*b* and 436*c* respectively. A solenoid relay 488 operates to selectively move the moveable assembly in the following manner:

Assuming that solenoid relay 488 is deenergized, spring 476 normally urges the moveable assembly to the position shown in FIG. 13 whereby sealed opening 472*a* seals the conduit 478 coupled to the 90 PSI source. One-way passageway 472*c* is in alignment with conduits 480 and 486 coupling the 30 PSI source to cylinder inlet 436*a*. Oneway passageway 472*b* is aligned with conduits 484 and 482 allowing air under pressure to leave cylinder inlet 436*b* and be exhausted through conduit 482.

Upon energization of relay solenoid 488, the moveable assembly is moved in the direction shown by arrow A10 to move one-way passage way 474*a* into alignment with conduits 478 and 484, coupling the 90 PSI source to cylinder inlet 436*b*. Diagonally aligned passageway 474*b* is aligned with conduits 486 and 482 causing air under pressure passing through inlet 436*a* to be exhausted through conduit 482. Conduit 480 coupled to the 30 PSI source is sealed by sealed opening 474*c*. In the event of a momentary or permanent power loss, the pressure coupling assembly returns to the position shown in FIG. 13 coupling the 30 PSI source to inlet 436*a* of cylinder 436 retaining the rotatable assembly in the halted position.

The moveable sidewall assemblies are moved at the time that the turntable 42 is halted, and vice versa.

Although motor 290 rotates with the rotation of turntable 42, the sprockets and drive chains forming part of the assembly for driving the moveable sidewalls rotate in unison therewith so that the moveable sidewall assemblies experience no movement during rotation of the turntable.

After completion of turntable rotation through one-half revolutions, and after delivery of the last signature stack to the turntable, the servo motor 290 may be energized for pushing a completed compensated (or uncompensated) batch from the turntable assembly.

The controller is utilized to assure proper timing in the operation of the stacker and its various subassemblies, taking into account that stacker geometry and all of the operating time delays of the various subassemblies. For example, noting FIG. 1, the sensor 24 is located a predetermined distance from the intercept ready (i.e. "home") position. The distance between these points is predetermined and is based upon the geometry of the stacker. The travel time between the aforementioned two points is a function of the velocity of the signatures moving through the infeed section. The signature velocity is monitored by gear 527 and cooperating sensor 529 arranged within the infeed section 14. Gear 527 is mounted upon shaft 527*a*. Gear 527 is engaged by and is rotated by chain 35 which provides the drive from the rollers and belts of the infeed section. As each tooth of gear 527 passes sensor 529, sensor 529 generates a pulse. The generation of each pulse represents the linear movement of a signature through a predetermined incremental distance. The rate of occurrence of these pulses is a function of the speed at which the infeed section 14 is operating. The infeed section 14 may be operated either at a constant speed or a variable speed and is preferably operated at a variable speed which is a function of the rate of delivery of signatures S to the infeed section 14 by the press (not shown) and delivered to stacker 10 by conveyor 15. The faster the velocity of the infeed section, the greater the repetition rate of the pulses developed by sensor 529.

As one example, when the first signature of each batch passes beneath sensor 24, the controller senses this condition and loads a counter within the controller with a count based on the physical distance from sensor 24 and the intercept point. As the first signature travels from sensor 24 to the intercept point, pulses from sensor 529 are used by the controller to decrement the counter. When the counter has been decremented to zero, it signifies that the first signature is at the intercept point.

The controller senses this condition and operates a solenoid to introduce air under pressure into inlet 149e of cylinder 142 to move claw 146 and thereby move the stacking platform 36 in the intercept-ready position into the intercept position causing the first signature to be collected by the stacking platform moved from the intercept ready position to the intercept position. All of these actions occur while the stacking platforms are stationary.

Another delay interval which is taken into account is the time between activating of the solenoid which operates claw 146 and the movement of the stacking platform to the intercept position, which is a known physical delay and which is a function of the inertia of the moving components which include the solenoid armature, the pressure source and the claw moved thereby. This delay is subtracted from the time taken for a signature to travel from the signature sensor 24 to the intercept position to be assured that the claw 146 is moved from the intercept ready position to the intercept position at the proper time.

The drop delay time for the last signature of a stack being formed to settle on the stack is the time of travel of the signature from the intercept position to the time the signature reaches the back supports 213 of the signature bucket (FIG. 1), at which time the motor 32 driving the bucket chains is then driven by a ramp signal. During the drop delay time, the first and following signatures of the next batch are accumulated on the stacking platform used to perform the intercept. At the end of the drop delay, the signature stacking platforms 36—36″, which are held motionless, are then driven into movement by operation of the motor 32 which moves the drive chains 74—74′ to which the stacking platforms are coupled. The delay due to the inertia of the mechanical components is subtracted from the drop delay, in order to be assured that the movement of the stacker drive chains and stacking platforms begin at the end of the drop delay interval.

The completed stack of signatures is thereafter dropped upon the rotatable platform 42.

Upon completion of a stack of signatures, which is preferably a compensated stack, the gate/pushers 45, 47 (FIG. 1) are moved to push the compensated batch off of turntable 42 in readiness for forming the next compensated batch. The rotation of platform 42 and the movement of pushers 45, 47 are controlled to occur at an optimum time to allow each stack dropped from the stacking section to complete its vertical travel before any rotational or horizontal movement is performed. This inherently provides a neater and closely packed stack. The controller counts the pulses from sensor 176 which senses the gear teeth of gear 170 provided in the stacking section as shown in FIGS. 4 and 4a. For this application, the controller uses the pulses to determine the rate at which the next batch is being accumulated in the stacking section and times the movement of platform 42 and pushers 45, 47 such that either action will be completed before the next batch is dropped from the stacking section. With this method the maximum time can be allowed for the dropped batch to complete its vertical travel regardless of the batch accumulation rate. Due to the inherent mechanical delay in the pusher/gate components due to inertia, the push command signal is initiated prior to the actual initiation of the movement of the gate/pushers 45, 47.

The speeds of the drive chains moving the stacking platforms 36—36″ and the drive chains moving the gate pushers 45, 47 are monitored to control the speed of the respective drive chains in the case of the stacking platforms, after the drop delay period has elapsed (less the inherent delay interval due to the inertia of the stacking section mechanical components) the controlling controls motor 32 to accelerate the stacking platforms 36—36″ at a constant rate from a stand still up to a predetermined velocity, by applying an ascending ramp signal input to the stacking section drive motor 32. The sensor 176 sensing the gear teeth of the gear 170 provided in the stacking section as shown in FIGS. 4 and 4a generates pulses which are counted by the controller to track the distance travelled by the stacking platform 36 in moving from the intercept position to a predetermined location at which the stacking platform begins to move out from beneath the completed stack. When the number of counts reaches a predetermined value, a constant amplitude signal is applied to the motor to move all of the stacking platforms at a constant velocity. When a count is developed which indicates that a stacking platform has reached the near home position, the controller applies a descending ramp signal to motor 32 to significantly reduce the velocity of the stacking platforms. Thereafter a constant amplitude signal is applied to the stacking section drive motor for a brief period of time until the home sensor indicates that the stacking platform which is next to receive signatures has arrived at the intercept ready position, at which time the controller applies a descending ramp signal to bring the stacking platform to a halt at the intercept ready position, preferably by dynamic braking. By significantly reducing the linear speed of the stacking platform prior to the time that the stacking platform reaches the home position as detected by the home sensor 178, this technique significantly enhances the ability of the system to bring the stacking platform to a halt precisely at the intercept ready (home) position.

The motor 290 shown in FIG. 10 for example and employed for moving the gate/pushers 45 and 47 shown in FIG. 1, is operated in a similar fashion wherein the controller applies an ascending ramp signal to motor 290 to rapidly accelerate the gate/pushers 45–47. After a predetermined interval, the controller thereafter applies a constant level signal to motor 290 for a predetermined interval, and then applies a descending ramp signal to motor 290 to reduce the operating speed to a small fraction of the highest operating speed, this speed being maintained until a near home sensor 360 (or 362) detects the gate pusher as approaching the home position, at which time a descending ramp signal of steep slope is applied to motor 290 to bring the gate pusher to a halt at precisely the home position.

Ideally, the stacking platform receiving signatures should be moving at a velocity which assures the formation of a neat stack of signatures delivered thereto. This is best accomplished when the stacking platform is moved at the slowest possible velocity commensurate with the rate at which signatures are delivered from the press to the stacking platform.

The controller is programmed to compute an initial velocity which is satisfactory for stacking signatures, given the input parameters of infeed speed, batch size and stacker delays.

In order to optimize the stacking operation the stacking platform should be moved at the same velocity commensurate with the velocity of signatures being delivered to the stacking platform from the infeed section and commensurate with the number of signatures being delivered to the stacking platform per unit of time. This optimal operating speed yields a neat stack by allowing each signature sufficient time to come to rest upon the stacking platform. The stacking speed is initially computed in accordance with the parameters which effect stacking speed including infeed speed, batch size and the inherent stacker delays of the stacker mechanical components. The accuracy of the computed velocity of the stacking platform relative to the actual signature delivery rate affects the time that the stacking platform will be at the home position before intercepting a batch. For example the faster the stacking speed, the longer the period of time that the stacking platform will remain at the home position. So long as the time the last signature to be delivered to the next previous stacking platform is more than sufficient to assure that that last signatures reaches the back support of the stacking platform and settles upon the stack, it is preferably to reduce the stacking speed since the reduced stacking speed allows sufficient time for signatures following the first signature of a batch to reach the back supports of the stacking platform and settle upon the stack.

The amount of time that a stacking platform remains in the home position is determined. If the time spent in the home position is below a lower limit which provides insufficient time for the last signature of the preceeding stacking being formed to settle upon the stack, the previous stack speed is increased by a predetermined incremental amount.

If the time that the stacking platform remains in the home position is greater than an upper limit, indicating that more than adequate time is provided for the last signature of the stack being formed to settle upon the stack when the stacking speed is decreased by a predetermined incremental amount. The adjusted stacking speed is then saved as the "old speed" for use in the comparison operation performed preparatory to forming the next stack.

The system automatically controls the initiation of the turn and push operations. A turn operation is initiated after the drop of each batch of a compensated bundle except for the drop of the last batch forming the compensated bundle. A push operation is initialed a predetermined delay interval after a single batch bundle or the last batch of a compensated bundle has collected upon the turn table.

Cooperating gear 170 and sensor 176 provided as part of the signature stacking section 30 generates count pulses developed at a rate determined by the speed of the stacking chains. The accumulation of the count pulses is initiated when gear 170 passes home position sensor 178. When a predetermined number of count pulse is accumulated, the turn command signal is generated after a delay interval has elapsed. Although the count which initiates the turn operation is always the same, the time at which the count is reached varies as a function of the speed of the stacking platforms. The aforementioned delay period is sufficient to allow the signatures forming the stack to settle upon the platform, also taking into account the inherent delay in the mechanical components of the turntable, thereby enabling a reduction in the electronic delay.

The push command is also initiated a predetermined delay interval after accumulation of the aforementioned predetermined count. A push command occurs upon completion of a compensated stack or after the drop of a single stack bundle upon the turntable. The push interval is a fixed time interval but its initiation varies, as was mentioned hereinabove, as a function of the stacking speed.

FIG. 14 shows a simplified block diagram of the stacker electronic control system 500 comprised of microprocessor 502 and a combined read only/random access memory (ROM/RAM) 504. The system includes a microprocessor bus 506 through which microprocessor 502 and memory 504 communicate. A control panel 508 is coupled to microprocessor bus 506 through control panel interface 510. An interrupt/test generator 512 is also coupled to microprocessor 502 through bus 506 for stepping stacker 10 through its normal operation.

An input/output buffer circuit 514 selectively transfers data to and collects data from various control and sensing devices to be described in greater detail hereinbelow. Buffer circuitry 514 is coupled to microprocessor 502 through the microprocessor bus 506.

Considering the various sensor and control devices in greater detail, the operator panel 516 comprises six (6) push button operated switches designated as the start/-clear switch **516*a*, stop switch 516*b*, bypass switch 516*c*, left switch 516*d*, alternate switch 516*e* and right switch 516*f***.

The start switch **516*a* has the double function of start and clear. Pressing the start switch 516*a* once turns the stacker on. The stacker control 500 cycles the stacker through a routine in which the stacker software and hardware is initialized to place the stacker in readiness to receive signatures and form bundles. Operating the start button anytime thereafter and before the stop pushbutton 516*b*** is operated initiates a clear operation which performs turn and push operations to remove any partial or undesirable stack and operates the dump gate to clear any possible jams.

The stop button **516*b* causes abrupt disengagement of all power from the stacker 10 so that the stacking section 30 and table 42, as well as the pusher gates 45, 47 are left to remain in the position occupied immediately prior to removal of power. The start switch 516*a*** must be pressed again after a stop to restart the stacker.

The bypass button **516*c* operates the stacker dump gate 20 which opens to divert the flow of signatures entering the infeed section whereby the signatures are caused to fall to the floor and are diverted away from the stacker 10 by plate 38** to prevent the stacker from being damaged.

The left, alternate and right push button switches **516*d* through 516*f* select the direction that completed bundles are pushed from stacker 10. For example the left push button cause the completed bundles to be pushed out of the left side of the stacker. Push button 516*f* causes completed bundles to be pushed out of the right side of the stacker. Alternate push button 516*e*** causes each bundle to be pushed out of the left and right hand sides of the stacker in an alternating fashion. The selected push button is continuously illuminated to provide a visual indication of the selected push direction.

Control panel 508 is comprised of a function display **508*a*, a total copy display 508*b*, a function keyboard 508*c* comprised of a bundle size key 508*d*, preset value key 508*e*, odd count key 508*f* and associated LED 508*g*, count buffer key 508*h* and associated LED 508*i*, enter key 508***j*, total clear 508*k*, option 1 key 508*l* and associated LED 508*m* and option 2 key 508*n* and associated LED 508*p*; and numeric key group 508*q* including numeric keys "0" through "9", clear key 508*r* and set up key 508*s*; and set up switch 508*t*. Operating the set-up key (with the set-up switch 508*t* in the off position) allows the operator to scan through each of the parameters stored in memory (such as the push and turn delay, home position time, settling time, etc.). Moving the set-up switch 508*t* to the on position allows the stored parameters to be examined and altered. A key operated lock 508*u* prevents stored parameters from being changed by unauthorized personnel.

The basic data is inputted through control panel 508. For example, depressing bundle size key 508 causes the function display 508*a* to display the legend "BUNDLE SIZE". The total number of copies per bundle are chosen by operating the numeric keys in numeric keyboard group 508*q*. The value displayed in the total copy display 508*b* is entered by depressing enter button 508*j*. All of the values capable of being entered through the control keyboard may be cleared by operating clear button 508*r*. Operating the present values key 508*e* causes optimum values stored in firmware to be utilized as the set-up values for operation of the stacker. The optimum values include intercept delay, settling time delay, push delay and turn delay. Selection of these values assures proper operation. however, these values may be substituted by values placed in changeable memory as will be more fully described.

Operating the odd count key 508*f* energizes its associated LED 508*g* and causes odd bundle counts to be determined internally or controlled by an external "dumb" or "smart" programmer. For example, if a bundle size of 122 is inputted, by selecting the odd count key, the associated program will create a bundle comprised, for example of four (4) stacks of 25 signatures and a final stack of 22 signatures. The last stack count is also compared against both a maximum value and a minimum value to determine how to deal with the last bundle. For example to form a bundle of 127 signatures one option is to form five (5) stacks of 25 signatures and one stack of two signatures. Comparing the value 2 against the stored minimum value (for example 15) would cause the last stack of two (which is smaller than the minimum amount) to be part of the last stack of twenty-five whereby the stacker will form four stacks of twenty-five signatures and one stack of twenty-seven signatures. A twenty-seven signature stack is compared against the stored upper limit (for example 35) and is found to be permissable.

The count buffer key 508*h* is operated when it is desired to change the filter value used to filter count pulses from counter 24 (FIG. 1). Under normal conditions count pulses must occur 2" apart i.e. at a time interval sufficient to indicate a 2" spacing between the folded leading edges of successive signatures. The microprocessor accumulates pulses representing distance travelled since the last count pulse. If the next count pulse occurs in an accumulated distance of less than a count equivalent to a travel distance of 2", an error signal is generated. If the count pulse occurs when the accumulated count is 2" or greater, the operation continues without interruption. By operating the key 508*h* the filtering period is increased to a 4" interval. When pulses occur during a time interval which is less than the selected spacing distance (2" or 4") an error signal is generated suggesting to the operator that the signature stream should be examined to determine the cause of the improper spacing.

The option 1 and option 2 keys 4081 and 508*n* and their associated LEDs 508*m* and 508*p* are provided to accomodate special options which may be desired dependent only upon the desires of the particular user. Some selectable applications include pushing bundles out of the stacker in other than an alternating pattern (such as two bundles to one side, one bundle to the opposite side); accomodating a labeller; etc.

The aforementioned parameter data is entered by operating the set up switch 508*t* so that its arrow marker 508*u* is aligned with the "ON" position after unlocking lock 508*u*. After the set up information is introduced (or altered) the set up switch is rotated so that its marker 508*u* is aligned with the "OFF" position and lock 508*u* is locked.

The table block 518 shown in FIG. 14 contains the control valve 518*a* provided for coupling air under pressure from an air pressure source (not shown for purposes of simplicity) in the air dispensing ports 255 arranged at predetermined locations upon the turntable 42. A second control valve 518*b* is provided for coupling air pressure to the cylinder employed for rotating turntable 42.

The pusher block 520 services the pusher motor 290 receiving an operating signal from the microprocessor 502 for operating the gate/pushers 45, 47 and further includes the sensors comprising the home position sensor 364 and two near home position sensors 360, 362 (FIG. 6) on opposite sides of the home position sensor utilized to decelerate the gate pusher operating motor 290 to an approach speed prior to the gate/pusher reaching the home position. The motor 290 is brought to an abrupt halt when the home sensor 364 senses the gate/pusher at the home position.

The stacking section block services the two sensors 176, 178 (FIG. 4*a*) utilized for tracking the stacking platform, including sensor 176 for counting the geat teeth of the gear provided in the stacking section and sensor 178 for detecting the home position of the stacking section tracking gear. The home position sensor 178 initiates the accumulation of sensing pulses while the gear tooth sensor 176 generates pulses with the passage of each gear tooth for creating the accumulating count.

The pneumatic block 524 contains an air presence verification switch which closes when the air pressure source is functioning properly.

The infeed block 526 contains the sensor 529 (FIG. 1) which generates the speed/distance pulses developed by the speed sensor 529 provided in the infeed section 14 and the signature counts developed by the counter 24 provided in the infeed section.

The flow diagram of FIGS. 15, 16 and 17 diagramatically disclose the operation of the control system which in one preferred embodiment comprises a Model 7085-1 which is a combination microprocessor, ROM and RAM manufactured by PROLOG. Considering FIG. 15, when the stacker start button 516 shown in FIG. 14 is depressed, the microprocessor 502 enters into the initial step 530 of the program. The program then initializing software and hardware at 532 and services the keyboard entries (from panels 508 and 516) at 534. If any keyboard entries have been made, they are entered into the microprocessor which then updates the dated displays at 536. At 538, the microprocessor updates and displays the paper total, i.e. the total number of signatures processed to date.

Thereafter, at 540, control of the table 42 and pusher/gates 45, 47 is performed by the microprocessor. At 542, the stacking section speed control activities are performed. The microprocessor then loops back to step 534 and continuously services the keyboard displays, table pusher and stacking sections in a repetitive fashion.

The elapsed time after initiation of the turn command is accumulated. The accumulated elapsed time is compared against a stored value when the home position sensor 370 and 372 (FIG. 6) senses completion of a half-turn to determine if the turn has been completed within an acceptable time interval. The accumulated time is also periodically compared with the stored value to initiate a jam condition if the elapsed time is greater than the stored value. A similar operation is performed for each push operation.

The microprocessor 502 further includes a real time clock which initiates an interrupt of the normal routine at 550 every two milliseconds. Upon initiation of an interrupt at 552 the timers are incremented and the input/output buffer is serviced. This step more specifically includes incrementing timers used to monitor stacking functions such as time at home position; time in turn operation; time of push operation. These accumulated time values are compared against stored values to be assured of proper operation. For example, if the push operation is not completed within a predetermined time interval this indicates a further condition which may initiate a halt operation. This is also true of the turn operation.

During the interrupt phase the signature are processed at 554, in that the microprocessor looks for the development of a pulse by the signature counter 24 (see FIG. 1) which initiates the tracking of each signature. At 556, pulses developed by the sensor 529 are collected which sensor 529 detects passage of the gear teeth of gear 527 which pulses represent infeed speed. Although the travel distance between pulses (i.e. between teeth) is fixed the time between pulses is a function of the operating speed of the infeed section 14 (FIG. 1).

The pulses accumulated for each signature whose passage is detected by signature counter 24 are accumulated and maintained in appropriate memory locations at step 558.

The next step to be performed in the normal software routine is stored at the initiation of the interrupt represented at 550 in FIG. 15. When the interrupt routine is terminated, at 560, the microprocessor exits from the interrupt routine and returns to the next program step to be performed in the normal routine by returning to the program step whose location was stored in memory at step 550 of the real time clock interrupt routine. The interrupt routine is repeated every two milliseconds and performs in the same manner as described hereinabove.

The stacking section control subroutine flow diagram is shown in greater detail in FIG. 16. Upon entry into the subroutine 542, at 542*a*, the program advances to step 542*b* to look for the first paper of a new batch. If the paper reaching the stacking section is not the first paper of a new batch, the accumulated time of the stacking platform presently in the home or intercept ready position is increased by one time increment and the program exits at 542d to return to the service keyboard entry subroutine 534 shown in FIG. 15.

Assuming that the next time that the computer returns to the control stacking section subroutine 542, and that at 542*b*, the first paper of the batch is nearing the intercept position, a branch occurs at 542*b*-2 to 542e at which time the first paper is intercepted. More specifically, the microprocessor activates the valve associated with pneumatic cylinder 148 to introduce air under pressure into opening 149*d* shown in FIG. 5*d* to move claw 146 in the direction shown by arrow 162. Claw 146 thus abruptly swings the stacking platform in the home position downwardly so that its free tips move from the position 164*a* shown in FIG. 2 to the dotted line position 164*a*′, thereby moving the tips 164*a* through the path of movement of the incoming signature stream and causing the first signature of the new batch to be collected upon the stacking platform presently in the home position while allowing the last signature of the batch presently being completed to be delivered to the stacking platform 36′.

The program then advances to step 542f which initiates a delay between the intercept operation and the initiation of the movement of the stacked platform drive chains which delay period is adjustably selected to be of a length sufficient to allow the last signature of the batch presently being delivered to stacking platform 36′ to reach the back supports 213 (see FIG. 2) and settle upon the completed signature batch.

While waiting for the delay period to elapse, the program then advances to step 542*g* at which time the batch accumulation speed is calculated. This calculation is performed as part of the stacking section speed control subroutine shown in FIG. 17 which will be described in detail hereinbelow.

Upon completion of the batch accumulation speed computation, the microprocessor advances to a step 542*b* of the subroutine shown in FIG. 16 to perform a high speed drop of the stacking section. This is accomplished, as will be more fully described, by rapidly accelerating the stacking section drive chains at a substantially constant rate and, after the stacking platforms have reached a predetermined velocity, the subroutine advances to step 542*i* to drive the stacking section at the computed speed when the stacking platform has advanced to a predetermined location which is determined by the count of pulses developed by the sensor 176 which detects the passing of the gear teeth of gear 170 shown in FIGS. 4 and 4*a*. The stacking section drive chains are driven at the uniform computed speed until the stacking platform closest to the home position reaches the near home position. The microprocessor advances to step 542*j* to determine if the stacking platform has arrived at the near home position which constitutes a predetermined count of pulses accumulated from sensor 176 of FIG. 4. The computer continues to loop between branch path 542*j*-2 so long as the stacking platform does not reach the near home position.

When the accumulated pulses developed by the stacking section sensor reaches a predetermined magnitude indicating that the stacking platform closest to the intercept ready position has reached the near home position, the approach speed is set at step 542k at which time a descending ramp signal is applied to the stacking section motor 32 to linearly decelerate the stacking platforms. The program then advances to step 542*l* to determine the stacking section count. When the count reaches a predetermined magnitude, indicating that the stacking platform has reached the home or intercept position, the program advances to step 542*m*, branching from 542*l*-2. In the event that the stacking platform has not yet reached the home position, the program branches at **542*l*-1** and continues to loop until the aforementioned count is achieved.

At step **542*m*, the stacking section platforms are halted by braking the stacking section motor 32** by dynamic braking.

Thereafter, the microprocessor advances the step **542*n* at which time the microprocessor resets the time accumulated for the stacking platform at the home or intercept ready position, preparatory to accumulating a new count of elapsed time of the next platform to arrive at the home position. The program then returns to the service keyboard entry subroutine 534 shown in FIG. 15 by way of the exit step 542*o***.

The stacking section speed calculation and control subroutine is shown in FIG. 17. The microprocessor enters this subroutine at step 562 and advances to step 564 to compute the time to accumulate the next batch and the analog voltage necessary for driving the stacking section. This calculation is based upon the parameters introduced to the microprocessor and shown at 566, which include velocity of incoming papers (infeed speed), batch size, stacker delays, i.e. mechanical delays of the mechanical elements including the pneumatic valves and cylinders. The calculation may be performed either through a table look-up routine or through a real-time calculation technique.

The time required to accumulate the next batch is converted into an analog voltage for driving the stacking section motor 32.

The program then advances to step 568 to determine if the computer is in the auto adjust mode. When the computer is not in the auto adjust mode, the program branches at **58*a* to step 588 which stores the "time next batch" for use as the "time last batch" and which stores the calculated speed as the "old speed". The stored "time next batch" value is used for comparison purposes, as will be more fully described. Thereafter, the output speed signal is transferred to the stacking section motor 32 at 590. This is accomplished by transferring the stacking speed voltage, in binary form to the stacking section electronics 522 through I/O buffer 514. This digital value is converted into analog form for application to the stacking section motor 32**.

The subroutine of FIG. 17 is completed at this time and the microprocessor returns to subroutine **542*h* shown in FIG. 16 through the exit step 592 of FIG. 17**.

In the event that the system is in the auto adjust mode, the computer branches at **568*p* of FIG. 17, advancing to step 570 to compare the time to accumulate the next batch computed at step 564 against the computation made preparatory to initiation of the prior stacking operation, which computation was stored at step 588. The result of the comparison is examined at step 572. If the present calculation is not the same as the previous calculation, the routine branches at 572*a* and stores the present calculation at step 588**.

If the present calculation is the same as the previously stored calculation, the signature count and infeed section speed/distance counter are examined. If these counts indicate the completion of the last batch, the program branches at **574*a* to store the computed time for accumulating the next batch at step 588**.

In the event that the two previously mentioned counts indicate that the last batch is not yet over, the program branches at **574*b* to examine the elapsed time that the stacker platform in the home position has been maintained in the home position at step 576. The program advances to step 578 at which time the elapsed time at the home position is compared against the predetermined lower limit. If the elapsed time at the home position is less than the predetermined lower limit, the program branches at 578*b* and increases the old speed at 582 by predetermined increment. In one preferred embodiment this is accomplished by adding a stored increment to the "old speed" previously stored at step 588** during the immediately prior speed calculation routine performed by the system.

In the event that the elapsed time at the home position is greater than the predetermined lower limit, the program branches at **578*a* to 580 where the elapsed time at the home position is compared against a predetermined upper limit. If the elapsed time at the home position is less than the predetermined upper limit, the program branches at step 580*a* to step 586 at which the microprocessor retrieves the "old speed" and then saves the old speed at step 588**.

In the event that the elapsed time at the home position is greater than the predetermined upper limit, the program branches at **580*b* to step 584 at which time the old speed is decreased by a predetermined increment which is preferably substantially the same magnitude as the increment used to increase the "old speed". Thereafter, the program advances to step 588** which is performed in a manner described hereinabove.

A summary of the operation of the stacker controller will now be set forth, making reference to FIG. 18:

The first signature is detected by the signature counter 24 at an arbitrary time $t=0$ developing the leading edge **600*a* of a square pulse 600. An adjustable delay period after leading edge 600*a*, which delay is primarily a function of the velocity of the signature stream in the infeed section, a pulse signal 602** is generated, taking into account the time required for the first paper to move from the count location to the intercept location less the time required for operation of the mechanical elements performing the intercept operation, including the claw, the claw actuating cylinder and the stacking platform.

At time $t=0$, the drop delay period is initiated as represented by the leading edge **604*a* of waveform 604. The drop delay interval is that time between the detection for the folding leading edge of a signature by counter 24 to the time that the stacking platforms again begin to move. The execute drop signal is represented by pulse 606 which is initiated a predetermined time prior to the actual start of the initiation and movement of the stacking platforms which occurs at time $t_2$. Curve 608 represents the velocity of the stacking platforms as a function of distance measured by the number of distance counts generated by sensor 176 employed to count the gear teeth of gear 170 shown in FIG. 4. In the preferred embodiment, gear 170 has 60 gear teeth. At the home position, home position sensor 178 senses the opening 170*a* in gear 170 initiating the accummulation of distance counts. Microprocessor 502 applies a ramp signal to the stacking section motor 32 (see FIG. 1) causing the stacking platforms to rapidly accelerate toward a constant velocity which is nominally 20 inches per second and reaches the aforesaid constant velocity when the number of counts equals 10. The microprocessor then delivers a constant DC signal to stacking section motor 32, the value of which is determined during the performance of the stacking section speed control subroutine shown in FIG. 17 and specifically performed at step 564** thereof.

When the number of accumulatd distance counts reaches 10, the stacking platform which was last released from the home position, begins to move out from beneath the completed signature stack allowing the completed signature stack to drop to the turn table 42. This drop is represented by waveform 610 which, at time $t_3$ indicates the position of the stack as being 23 inches above the turntable at point 610*a*. The just completed stack hits turntable 42 at point 610*c*. At point 610*b* intermediate end points 610*a* and 610*c*, rotation of turntable 42 must be completed to prevent the moving sidewalls from interfering with the drop of the completed stack of signatures.

As time $t_4$ an execute turn command, as represented by pulse 612, is generated by the microprocessor. This command is generated when a predetermined number of distance counts have been accumulated. The time occurence of this count varies as a function of the stacking section speed. For example, if the stacking section speed is greater than the nominal value shown by curve 608, the count at which the execute turn command is generated will occur earlier than time $t_4$, and vice versa. The actual turn begins at time $t_5$ as represented by pulse 614. The time required to rotate turntable 42 is fixed and, in the preferred embodiment the turntable ideally completes a one-half turn in an elapsed time of 0.7 seconds and, as a practical matter should complete the turn in 0.82 seconds.

The stacking platform as was mentioned hereinabove, starts to release the completed signature stack (by moving out from beneath the stack) about the time that the 10 distance counts have been accumulated, i.e. time $t_3$. At this time the stacking platform executes at 180° turn about the lower end of plates 54, 54' and moves upwardly along the chain path where it again moves through a 180° turn about the upper ends of plates 54, 54' in returning to the home position. When the stacking platform reaches a near home position and, for example in one particular embodiment, when 43 distance counts are accumulated, the microprocessor applies a decending ramp signal to the stacking section motor 32 which is represented by curve portion 608*c* in order to reduce the velocity of the stacking platform as it approaches the home position. When the accumulated distance counts reach a count of the order of 56, for example, the decending ramp signal is converted to a constant voltage signal as represented by curve portion 608*d*. The velocity at this time is of the order of 10 to 20 percent of the velocity of the stacking platform represented by curve portion 608*b*.

When the stacking platform passes the home sensor 178, the microprocessor abruptly halts the stacking platforms through the use of dynamic braking to motor 32 as represented by the decending curve portion 608*e*. By reducing the velocity of the stacking platforms prior to one of said stacking platforms reaching the home position, the last mentioned stacking platform is brought to a precision stop at the desired home position. More importantly, the precision stop is accomplished without the need for an electromagnetic brake and clutch normally employed in conventional stackers.

The push operation is initiated either after the last stack forming a compensated bundle has been delivered to the turntable 42 or when a bundle of only a single signature stack is to be formed. At this time not turn operation is either required or performed. At $t_4$, the push command 616 is executed based upon accumulation of a predetermined number of distance counts and when the number of stacks reach a present count. Due to the inherent delays in the mechanical components utilized to perform the push operation, the actual push operation begins at time $t_6$ which is a predetermined delay interval after the execute push command. The microprocessor applies an ascending ramp signal to the gate/pusher motor 290 (see FIG. 11) causing the gate pushers to accelerate from 0 velocity at time $t_6$ as shown by curve portion 618*a* to a constant velocity initiated at time $t_7$. The gate pushers are maintained at the constant velocity until time $t_8$ as represented by curve portion 618*b*. At time $t_8$, the microprocessor applies a decending ramp signal to the gate pusher motor 290 causing the gate pushers to decelerate until time $t_9$. The decending ramp signal is generated by the microprocessor responsive to detection of the passing of a gate pusher by one of the near home position sensors 360 or 362 shown in FIG. 6, dependent upon the direction in which the gate pushers are moving. The microprocessor rapidly decelerates the gate pushers until time $t_9$ and thereafter maintains the movement of the gate pushers at a constant velocity between time $t_9$ and $t_{10}$. When the home position sensor 364 detects the gate pusher, the microprocessor is activated to halt the pushers through the application of dynamic braking to gate pusher motor 290, to bring the gate pushers to a halt at time $t_{11}$.

Returning to a consideration to curve 608 representing the velocity of the stacking platforms versus time it can be seen that time $T_h$ that a stacking platform remains at the home position is a variable and varies as a function of the stacking speed of the stacking platform as represented by curve portion 608*b*. If the elapsed time at the home position is too long, this is indicative of the fact that insufficient time is provided for allowing each of the signatures collected by the stacking platform prior to reaching the home position to be properly and neatly collected upon the stacking platform. On the other hand, if the elapsed time at the home position is too short, insufficient time is provided for the last signature of the stack presently being formed to properly settle upon the stack. By comparing the elapsed time against predetermined upper and lower limits the stacking speed is adjusted either up or down according to the results of the aforementioned comparison operations, thereby moving the stacking platform at the lowest practical stacking speed comensurate with the speed of the incoming signature stream and the size of the signature stack, to thereby assure the formation of a neat signature stack. In the preferred embodiment, the speed change is a predetermined increment and may for example be in the range from 0.5 to 2 inches per second added to or subtracted from the last calculated speed with the preferred incremental change being one inch per second.

The interrupt test generator 512 shown in FIG. 14 runs the stacker through a test sequence by simulating a press input rate of (A)×1,000 signatures per hour, the number A being a real number to select an input rate between 10,000 and 80,000 papers per hour. In the test mode only the speed distance and the paper pulses are simulated by the microprocessor, all other functions occur in real time.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A turntable assembly for forming compensated signature bundles comprising:

a support frame;

a platform;

means for rotatably mounting said platform on said frame;

a pair of moving sidewall means arranged in spaced parallel fashion on said platform for engaging, receiving and embracing opposite parallel sides of signatures to support a stack of signatures in an upright manner therebetween;

each of said moving sidewall means including a plurality of gate/pusher members arranged at spaced intervals about the moving sidewall means, selected ones of said gate/pusher members of both of said moving sidewall means extending towards one another in embrace the sides of the signatures perpendicular to those sides embraced by the moving sidewall means;

each of said moving sidewall means further comprising an upright support frame and a closed-loop moving wall assembly surrounding the support frame and movable thereabout, said gate/pusher members being arranged at spaced intervals about the moving wall assembly and movable therewith;

drive means rotatable with said platform for moving the closed-loop moving wall assemblies in unison for pushing signatures off the platform by at least one of the gate/pushers;

means for rotating said platform through one-half revolutions in successively opposite directions comprising air cylinder means having a reciprocating rod driven by a piston, the opposite free ends of said air cylinder means and said piston being respectively swingably coupled to said platform and said frame for rotating said platform by movement of the piston under control of an air pressure source;

passive dampening means swingably coupled to said platform and said frame for rapidly decelerating the rotational movement of the platform during the latter portion of its rotation while permitting the rotational movement of the platform during the major part of its rotation to occur substantially unimpeded.

2. The turntable assembly of claim 1 wherein the dampening means comprises at least one shock absorber assembly having an air chamber which rapidly expands during the first stroke of said air cylinder to receive air and which contracts during the second stroke of the air cylinder whereby the air in the air chamber is compressed to retard the contraction of said air chamber.

3. The turntable assembly of claim 1 wherein the air cylinder is provided with first and second control inputs for respectively receiving air under pressure during the first and second strokes of the air cylinder;

means for coupling the first control input to a first pressure source while enabling air to freely exhaust from the second control input during said first stroke and for coupling the second control input to a second pressure source while enabling the first control input to freely exhaust air during the second stroke, the pressure of said first pressure source being substantially greater than said second pressure source.

4. The turntable assembly of claim 3 wherein the pressure of said second pressure source is less than half the pressure of said first pressure source.

5. The turntable assembly of claim 3 wherein the pressure of said second pressure source is approximately one-third of said first pressure source.

6. The turntable assembly of claim 3 wherein said control means comprises solenoid controlled valve means selectively coupling the first pressure source to one of said control inputs and for enabling the remaining one of the control inputs to be exhausted to the atmosphere when in a first position and for selectively coupling the second pressure source to the other one of the control inputs and for enabling the remaining one of the control inputs to be exhausted to the atmosphere when in a second position.

7. The turntable assembly of claim 6 further comprising sensing means for sensing the rotation of the platform for altering the position of the valve means when the platform reaches a predetermined angular orientation.

8. The turntable assembly of claim 7 further comprising identification means movable with the movement of said platform;

said sensing means sensing movement of the identification means past said sensing means for generating a control signal;

means responsive to said control signal for moving said valve means to said second position.

9. The turntable assembly of claim 8 wherein identification means are provided at locations arranged at 90° intervals about the periphery of the platform.

10. The turntable assembly of claim 9 wherein each identification means has a plurality of identification members of either a first or second type;

the combination of said members at each location being different from the remaining locations;

said sensing means sensing the members at each location to determine which identification means is passing the sensing means.

11. The turntable assembly of claim 10 wherein said sensing means comprises a plurality of magnetic type sensors;

one type of said identification member being capable of inducing a signal in the associated magnetic type sensor as it passes the sensing means;

and the other type of identification member being incapable of inducing a signal in the associated magnetic type sensor as it passes the sensing means.

12. The turntable assembly of claim 11 wherein the sensing means generates signals representing a multi-bit binary code at each identification means passes the sensing means, each multi-bit binary code being different from the remaining multi-bit binary code.

13. The turntable assembly of claim 6 further comprising:

means for initiating rotation of said platform by generating a rotation initiation signal;

said valve means being moved to said first condition responsive to said rotation initiation signal.

14. The turntable assembly of claim 1 further comprising means for monitoring the rotation of the platform said monitoring means comprising a plurality of members moveable with said platform and arranged at spaced intervals about said platform;

plural stationary sensing means arranged adjacent to said platform for generating position signals when aligned with one of said position members.

15. A turntable assembly for forming signature stackers comprising:

a support frame;

a first support housing mounted on said support frame;

a platform;

a platform support extending into said support housing;

means in said first support housing for rotatably supporting said platform support in said first support housing;

motor drive means joined to said platform support and having a drive shaft extending through said platform support;

a pair of movable wall assemblies arranged in spaced parallel fashion upon the platform and including closed loop movable wall means for engaging and supporting a stack of signatures;

means arranged along the underside of said platform coupled between said drive shaft and said movable wall assemblies for coupling drive from said drive shaft to said movable wall assemblies;

each of said movable wall assemblies including at least one gate/pusher means for pushing articles deposited in the region between said movable wall assemblies off of said platform.

16. The turntable assembly of claim 15 further comprising drive means for rotating said motor drive means, said platform support and said platform in unison.

17. The turntable assembly of claim 15 further comprising means in said platform support for rotatably supporting said drive shaft.

18. The turntable assembly of claim 15 further comprising a first and second closed loop chain drives;

a first and a second plurality of sprockets rotatably mounted along the underside of said platform;

the first and second chain drives being respectively entrained about the first and second plurality of sprockets;

one sprocket of each of said first and second plurality of sprockets being coupled in common to said drive shaft;

another sprocket of said first plurality of sprockets being coupled to one of said moveable wall assemblies;

another sprocket of said second plurality of sprockets being coupled to the other one of said moveable wall assemblies;

a third one of the sprockets in said first and second plurality of sprockets being swingably mounted;

biasing means for biasing said third one of the sprockets of said first and second plurality of sprockets for maintaining the associated drive chain under proper tension.

19. The turntable assembly of claim 18 wherein one of the swingably mounted third sprockets moves against the force o said bias means and the other one of the swingably mounted third sprockets moves in the direction of the bias means as said drive shaft rotates in a first direction.

20. The turntable assembly of claim 19 wherein the swingably mounted third sprockets reverse their direction of movement when said drive shaft rotates in a second direction so that the first mentioned third sprocket swings in the direction of the force applied thereto by the bias means and the last mentioned third sprocket swings in a direction opposite the direction of the force applied by the bias means.

21. The turntable assembly of claim 18 wherein the swingable mounting for each of the third sprockets comprises an elongated member pivotally mounted at one end to the underside of the platform;

one of the third sprockets being rotatably mounted upon said elongated member;

said bias means having one end mounted to said platform and another end engaging said elongated member.

22. The turntable assembly of claim 21 wherein said bias means ia gas spring means.

23. The turntable assembly of claim 18 further comprising first and second near home sensors arranged at spaced intervals on said platform for sensing the passage of one of said gate/pusher means for generating a near home signal;

motor control means responsive to a near home signal for controlling the motor to reduce its output speed as the gate/pusher means being sensed nears the home position.

24. The turntable assembly of claim 23 further comprising home sensor means arranged on the platform at the home position;

said motor control means further comprising means for abruptly halting said motor drive means when the gate/pusher means moves over said home sensor means.

25. The turntable assembly of claim 3 further comprising:

ball valve means arranged on the platform, each ball valve means being coupled to a source of air under pressure and including a mounting ring having an opening and a ball urged upwardly against the opening in said mounting ring by said air delivered to the ball valve means from said pressurized air source;

said balls being movable away from their mounting rings under the weight of a signature moving over the ball valve means for enabling air to be released through said ball valve means for creating a film of air between the platform and the last mentioned signature to facilitate movement of the signature as it is pushed along the platform by at least one of said gate/pusher means.

26. The turntable assembly of claim 15 wherein each movable wall assemblies comprises a support assembly mounted on said platform;

means at each end of the support assembly for rotatably mounting a shaft;

first and second sprockets being mounted at upper and lower ends of each shaft;

an upper sprocket chain entrained about the upper sprockets on said shafts;

a lower sprocket chain entrained about the lower sprockets on said shafts;

a plurality of vertically aligned pickets being joined to the upper and lower sprocket chains and forming a substantially continuous moving sidewall.

27. The turntable assembly of claim 26 wherein one of the sprocket shafts is movable relation to the other sprocket shaft;

has spring means for urging the aforesaid sprocket shafts apart to maintain the sprocket chains under proper tension.

28. The turntable assembly of claim 26 further comprising bias means for maintaining said upper and lower chains under proper tension.

29. The turntable assembly of claim 26 further comprising guide plates being slidable engaged by said pickets for maintaining alignment of the pickets extending between said sprockets to assure proper alignment of the signatures collected between said first and second movable sidewall means.

30. The turntable assembly of claim 18 further comprising gate/pusher means arranged at spaced intervals along said upper and lower sprocket chains and extending away from said pickets for pushing signatures collected between said first and second movign sidewall assemblies off of said platform.

31. The turntable assembly of claim 18 further comprising elongated runners arranged on said platform and extending above the surface of said platform for preventing the edges of the signatures from moving beneath the lower ends of the pickets.

32. The turntable assembly of claim 34 wherein three gate/pusher means are provided at equi-spaced intervals along said sprocket chains so that two of said gate/-pusher means embraced the sides of signatures adjacent and perpendicular to the intermediate side of the signatures engaging the pickets forming one sidewall supporting the signatures.

33. The turntable assembly of claim 31 wherein the remaining gate/pusher means is positioned along the run of the sprocket chains away from the signatures.

34. The turntable assembly of claim 30 wherein each gate/pusher means comprises an elongated resilient member extending away from said sprocket claim sand said pickets and acting as a gate for maintaining signatures stacked between the first and second moving sidewall upright and for pushing said signatures off of said platform when said movable sidewall means is moved.

* * * * *

UNITED STATES PATENT AND TRADEMARK OFFICE

CERTIFICATE OF CORRECTION

PATENT NO. : 4,812,099

DATED : March 14, 1989

INVENTOR(S) : Christer A. Sjogren et al.

It is certified that error appears in the above-identified patent and that said Letters Patent is hereby corrected as shown below:

Column 1, line 41, "delivery" should be --deliver--

Column 5, line 1, "an" should be --a--

Column 7, line 5, "THe" should be --The--

Column 7, line 54, "60" (second occurrence) should be --62--

Column 10, line 11, "rollers" should be --roller--

Column 10, line 25, "54b" should be --54h--

Column 11, line 26, "preferrably" should be --preferably--

Column 12, line 45, "268" should be --266--

Column 12, line 65, "THe" should be --The--

Column 14, line 60, "preferrably" should be --preferably--

Column 15, line 11, "gate/pusher" should be --gate/pushers--

Column 15, line 18, "pre-hole" should be --pre-home--

Column 16, line 8, "rotatably" should be --rotatable--

Column 16, line 10, "410" should be --310--

UNITED STATES PATENT AND TRADEMARK OFFICE

CERTIFICATE OF CORRECTION

PATENT NO. : 4,812,099

DATED : March 14, 1989

INVENTOR(S) : Christer A. Sjogren et al.

It is certified that error appears in the above-identified patent and that said Letters Patent is hereby corrected as shown below:

Column 17, line 2, "rotatably" should be --rotatable--

Column 17, line 4, "complete" should be --completes--

Column 17, line 50, after "is" insert --a--

Column 20, line 6, after "chains" insert --in accordance with a predetermined pattern. For example,--

Column 20, line 9, "controlling" should be --controller--

Column 21, line 49, "initialed" should be --initiated--

Column 21, line 59, "pulse" should be --pulses--

Column 24, line 3, "4081" should be "5081"

Column 24, line 5, "accomodate" should be --accommodate--

Column 24, lines 61-62, "initializing" should be --initializes--

Column 25, line 24, "in" should be --of--

Column 25, line 32, "signature" should be --signatures--

Column 26, line 34, "542b" should be --542h--

Column 29, line 14, "As" should be --At--

UNITED STATES PATENT AND TRADEMARK OFFICE

CERTIFICATE OF CORRECTION

PATENT NO. : 4,812,099

DATED : March 14, 1989

INVENTOR(S) : Christer A. Sjogren et al.

It is certified that error appears in the above-identified patent and that said Letters Patent is hereby corrected as shown below:

Column 29, line 33, "at" should be --a--

Column 29, lines 41, 46, and 54, "decending" should be --descending--

Column 29, line 65, "not" should be --no--

Column 30, line 1, "present" should be --preset--

Column 30, lines 12-13, and 14-15, "decending" should be --descending--

Column 30, line 28, "to" should be --of--

Column 31, line 20, "in" should be --to--

Column 33, line 57, "o" should be --of--

Column 35, line 12, "movign" should be --moving--

Column 36, line 13, "claim sand" should be --chains and--

Signed and Sealed this

Sixth Day of August, 1991

*Attest:*

*Attesting Officer*

HARRY F. MANBECK, JR.

*Commissioner of Patents and Trademarks*